US011316299B2

(12) United States Patent
Klinedinst et al.

(10) Patent No.: US 11,316,299 B2
(45) Date of Patent: Apr. 26, 2022

(54) ELECTRIC POWER DEVICE WITH INTEGRATED SAFETY MEASURE

(71) Applicant: SABIC Global Technologies B.V., Bergen op Zoom (NL)

(72) Inventors: Keith William Klinedinst, Dalton, MA (US); Daniel Caleb Brooks, Pittsfield, MA (US); Alex Robert Delaney, Pittsfield, MA (US); Peter James Zuber, Pittsfield, MA (US); John Samuel McKenzie, Pittsfield, MA (US); James Edward Barber, Pittsfield, MA (US); Trevor L. Jackson, Pittsfield, MA (US); Rebecca Lynn Blice, Pittsfield, MA (US); Carl Roy Stevens, Pittsfield, MA (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/948,153

(22) Filed: Sep. 4, 2020

(65) Prior Publication Data

US 2021/0066848 A1 Mar. 4, 2021

(30) Foreign Application Priority Data

Sep. 4, 2019 (EP) ..... 19195409

(51) Int. Cl.
*H01R 13/447* (2006.01)
*H01R 13/52* (2006.01)
(Continued)

(52) U.S. Cl.
CPC ..... *H01R 13/5213* (2013.01); *H01R 13/447* (2013.01); *H01R 13/502* (2013.01);
(Continued)

(58) Field of Classification Search
CPC ..... H01R 13/5213; H01R 13/447; H01R 13/502; H01R 13/701; H01R 13/7175; H01R 31/06
See application file for complete search history.

(56) References Cited

U.S. PATENT DOCUMENTS 4,643,505 A 2/1987 House et al.
4,869,683 A 9/1989 Nelson
(Continued)

FOREIGN PATENT DOCUMENTS

| | | |
|---|---|---|
| AU | 2010100095 | 3/2010 |
| EP | 1251600 | 11/2009 |
| EP | 3061158 | 3/2019 |

OTHER PUBLICATIONS

"110V 7 Wire Waterproof Cable Connector." Leader Energy CoLimited, Retrieved from https://leadergroup-cn.com/product/7-wire-waterproof-cable-connector. 2017.
(Continued)

*Primary Examiner* — Tho D Ta
(74) *Attorney, Agent, or Firm* — Norton Rose Fulbright US LLP

(57) ABSTRACT

In a particular implementation, an electric power device includes a body, a receptacle configured to receive a plug, and a source connector configured to be coupled to a power source. The electric power device further includes a casing coupled to the body and movable with respect to the body between a first position in which the casing defines an enclosed chamber and access to the receptacle is inhibited and a second position in which the casing is configurable to enable access to the receptacle for receipt of the plug. A transition from the first position to the second position is configured to cause the receptacle to be electrically decoupled from the source connector when the casing is at the second position, and a transition from the second posi-
(Continued)

tion to the first position is configured to cause the receptacle to be electrically coupled to the source connector when the casing is at the first position.

20 Claims, 16 Drawing Sheets

(51) Int. Cl.
*H01R 13/502* (2006.01)
*H01R 13/70* (2006.01)
*H01R 13/717* (2006.01)
*H01R 31/06* (2006.01)

(52) U.S. Cl.
CPC ..... *H01R 13/701* (2013.01); *H01R 13/7175* (2013.01); *H01R 31/06* (2013.01)

(56) References Cited

U.S. PATENT DOCUMENTS 5,217,387 A 6/1993 Hull et al.
5,306,176 A 4/1994 Coffey
6,482,017 B1 * 11/2002 Van Doorn ..... H01R 13/5213 439/149
7,938,660 B1 * 5/2011 Beak ..... H01R 13/701 439/269.1
7,942,684 B1 * 5/2011 Beak ..... H01R 13/701 439/188
9,531,107 B1 12/2016 Baldwin
2010/0186982 A1 * 7/2010 Gates ..... H01R 31/06 174/50
2014/0127926 A1 5/2014 Condo et al.
2016/0233608 A1 * 8/2016 Burrow ..... H01R 13/5213
2017/0012384 A1 1/2017 Sugino
2019/0109427 A1 4/2019 Chavez et al.

OTHER PUBLICATIONS

"Perma-Kleen Cordsets". Ericson. Retrieved Mar. 5, 2021 from https://www.ericson.com/product/perma-kleen-cordsets.
"Plug and Connector". Molex Woodhead Product Catalog. Retrieved from https://molex.com/woodhead. 2018.
Extended European Search Report Issued in Corresponding European Patent Application No. 19195409.8, dated Dec. 3, 2019.

* cited by examiner

ELECTRIC POWER DEVICE WITH INTEGRATED SAFETY MEASURE

CROSS-REFERENCE TO RELATED APPLICATIONS

This application claims the benefit of priority of European Patent Application No. 19195409.8 filed Sep. 4, 2019, which is hereby incorporated by reference in its entirety.

FIELD OF INVENTION

The present disclosure relates generally to electric power devices, and, but not by way of limitation, to extension cords and electrical outlets.

BACKGROUND

Extension cords can provide power from a power source to an electronic device at a location a distance away from the power source. In some situations, extension cords are used outdoors. Additionally, electrical outlets and outlet boxes may be located in an outdoor environment. Weather, such as rain, snow, or other precipitation, may cause a ground fault due to moisture at the point of electrical connection. Should the path to ground pass through a person, the person may experience burns or other injuries. Covers for extension cords are available, but such covers may still result in injury to a person if moisture gets within the cover when the extension cord is electrically connected to another cord or power source because the covers do not control the flow of electricity.

SUMMARY

The present disclosure describes electric power devices, such as extension cords and electrical outlets, operations thereof. An electric power device may be with integrated with one or more safety measures to provide for safe operation of the electric power device. The electric power device may include a body, a casing, a receptacle (configured to receive a plug), and a source connector (configured to be coupled to a power source). The casing may be coupled to the body and configured to move with respect to the body between a first position in which the casing defines an enclosed chamber and access to the receptacle is inhibited and a second position in which the casing is configurable to enable access to the receptacle for receipt of the plug. A transition from the first position to the second position is configured to cause the receptacle to be electrically decoupled from the source connector when the casing is at the second position, and a transition from the second position to the first position is configured to cause the receptacle to be electrically coupled to the source connector when the casing is at the first position. Accordingly, when in the second position, a user may insert a plug into the receptacle while the receptacle is de-energized. The electric power device may be operated to transition the casing to the second position which is configured to cause the receptacle (and thus the plug) to become electrically coupled to the source connector. To illustrate, in some implementations, electric power device may also include a coupling device (e.g., a mechanism for controlling the supply of power to the receptacle) that is configured to be operated by a user to cause the casing to transition between the first position and the second position, thereby resulting in the receptacle being electrically coupled and electrically decoupled with the source connector. In some implementations, the casing includes one or more indicators configured to provide a first indication of an electrical state of the source connector, a second indication of an electrical state of the receptacle, or both.

Thus, the present disclosure describes one or more electric power devices with at least one integrated/unitary safety measure. For example, the casing and the body may be configured to operate together to form an enclosed chamber that protects the receptacle and/or the plug from precipitation, such as rain or snow, or other moisture. Additionally, because the casing is in the second position when the plug is coupled to the receptacle, the receptacle is not coupled to the source connector when the plug is inserted into the receptacle. Instead, the receptacle is only coupled to the source connector when the casing is at the second position (e.g., after a user has inserted the plug into the receptacle). Thus, a danger of electrical shock to a user is prevented while inserting the plug into the receptacle.

In some of the foregoing embodiments, an electric power device for providing power to a plug comprises a body, a receptacle configured to receive a plug, and a source connector configured to be coupled to a power source. The electric power device further comprises a casing coupled to the body and movable with respect to the body between: a first position in which the casing defines an enclosed chamber and access to the receptacle is inhibited and a second position in which the casing is configurable to enable access to the receptacle for receipt of the plug. A transition from the first position to the second position is configured to cause the receptacle to be electrically decoupled from the source connector when the casing is at the second position, and a transition from the second position to the first position is configured to cause the receptacle to be electrically coupled to the source connector when the casing is at the first position.

In some such embodiments, the electronic device further comprises a power supply cord including one or more conductors coupled to the source connector or one or more indicators configured to provide a first indication of an electrical state of the source connector, a second indication of an electrical state of the receptacle, or both. Optionally, at least a portion of the body, the casing, or both is transparent to enable the plug coupled to the receptacle to be visible while the plug is coupled the receptacle when the receptacle is at the first position. Additionally, or alternatively, the receptacle comprises one or more conductive members configured to physically couple to one or more conductive members of the plug. Additionally, or alternatively, the casing includes a first portion and a second portion, and at least one of the first portion and the second portion includes a channel. In some such embodiments, the first portion is coupled to the second portion and is configured to rotate about the second portion while at the second position to enable access to the receptacle.

In some such embodiments, movement of the casing from the second position to the first position is configured to cause the casing to engage one or more flex spring arms coupled to the source connector such that, when the casing is at the second position, the one or more flex spring arms cause the receptacle to be electrically coupled to the source connector, and each of the one or more flex spring arms biased toward a position in which the receptacle is electrically decoupled from the source connector. Alternatively, the casing comprising a flexible plastic seal having a first portion and a second portion, in the first position, the first portion and the second portion are separable at an end of the casing to enable access to the receptacle, and in the second position, the first portion and the second portion are prevented by the body from being separated at the end of the casing to prohibit access to the receptacle.

In some such embodiments, the electric power device further comprises a coupling device configured to enable: movement of the casing in a first direction with respect to the body, the first direction corresponding to the transition from the first position to the second position, and movement of casing in a second direction with respect to body, the second direction opposite the first direction and corresponding to the transition from the second position to the first position. In some such embodiments, the coupling device comprises a twist barrel or a lever. In some such embodiments, when coupling device is the twist barrel, rotation of the twist barrel causes movement of the casing such that rotation in a first direction causes movement in a first direction and rotation in a second direction causes movement in a second direction opposite the first direction. Alternatively, when the coupling device comprises the lever: a first operation of the lever causes movement of the casing in a first direction with respect to the body, and a second operation of the lever causes movement of the casing in a second direction with respect to the body, the second direction opposite the first direction. Additionally, or alternatively, the body comprises an outlet box.

In some of the foregoing embodiments, a method of operating an electric power device comprises moving a casing of an electronic power device from a first position with respect to a body in which the casing defines an enclosed chamber and access to a receptacle of the electronic power device is inhibited, to a second position in which the casing is configurable to enable access to the receptacle for receipt of a plug. Moving the casing from the first position to the second position is configured to cause the receptacle to transition from being electrically coupled to a source connector of the electronic power device at the first position to being electrically decoupled from the source connector, such that the receptacle is electrically decoupled from the source connector while at the second position.

In some such embodiments, the method further comprises moving the casing of the electronic power device from the second position to the first position. Moving the casing from the second position to the first position is configured to cause the receptacle to transition from being electrically decoupled to the source connector at the second position to being electrically coupled to the source connector, such that the receptacle is electrically coupled to the source connector while at the first position. Additionally, or alternatively, the method further comprises while the casing is at the first position, receiving a first input to initiate movement of the casing from the first position to the second position, wherein moving the casing from the first position to the second position is responsive to the first input. The method includes, while the casing is in the second position: enabling access to the receptacle and receiving the plug at the receptacle. The method includes, after receiving the plug, receiving a second input to initiate movement of the casing from the second position to the first position, wherein moving the casing form the second position to the first position is responsive to the second input. The method further includes activating one or more indicators based on the receptacle being electrically coupled to the source connector when the source connector is in an energized state.

As used herein, various terminology is for the purpose of describing particular implementations only and is not intended to be limiting of implementations. For example, as used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). The term "coupled" is defined as connected, although not necessarily directly, and not necessarily mechanically; two items that are "coupled" may be unitary with each other. The terms "a" and "an" are defined as one or more unless this disclosure explicitly requires otherwise.

The term "about" as used herein can allow for a degree of variability in a value or range, for example, within 10%, within 5%, or within 1% of a stated value or of a stated limit of a range, and includes the exact stated value or range. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed implementation, the term "substantially" may be substituted with "within [a percentage] of" what is specified, where the percentage includes 0.1, 1, or 5 percent; and the term "approximately" may be substituted with "within 10 percent of" what is specified. The statement "substantially X to Y" has the same meaning as "substantially X to substantially Y," unless indicated otherwise. Likewise, the statement "substantially X, Y, or substantially Z" has the same meaning as "substantially X, substantially Y, or substantially Z," unless indicated otherwise. The phrase "and/or" means and or. To illustrate, A, B, and/or C includes: A alone, B alone, C alone, a combination of A and B, a combination of A and C, a combination of B and C, or a combination of A, B, and C. In other words, "and/or" operates as an inclusive or. Similarly, the phrase "A, B, C, or a combination thereof" or "A, B, C, or any combination thereof" includes: A alone, B alone, C alone, a combination of A and B, a combination of A and C, a combination of B and C, or a combination of A, B, and C.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range.

The terms "comprise" (and any form of comprise, such as "comprises" and "comprising"), "have" (and any form of have, such as "has" and "having"), and "include" (and any form of include, such as "includes" and "including"). As a result, an apparatus that "comprises," "has," or "includes" one or more elements possesses those one or more elements, but is not limited to possessing only those one or more elements. Likewise, a method that "comprises," "has," or "includes" one or more steps possesses those one or more steps, but is not limited to possessing only those one or more steps.

Any implementation of any of the systems, methods, and article of manufacture can consist of or consist essentially of—rather than comprise/have/include—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb. Additionally, the term "wherein" may be used interchangeably with "where".

Further, a device or system that is configured in a certain way is configured in at least that way, but it can also be configured in other ways than those specifically described. The feature or features of one implementation may be applied to other implementations, even though not described or illustrated, unless expressly prohibited by this disclosure or the nature of the implementations.

Some details associated with the implementations are described above, and others are described below. Other implementations, advantages, and features of the present disclosure will become apparent after review of the entire application, including the following sections: Brief Description of the Drawings, Detailed Description, and the Claims.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the implementation depicted in the figures.

DETAILED DESCRIPTION OF ILLUSTRATIVE IMPLEMENTATIONS

Figure 1A:
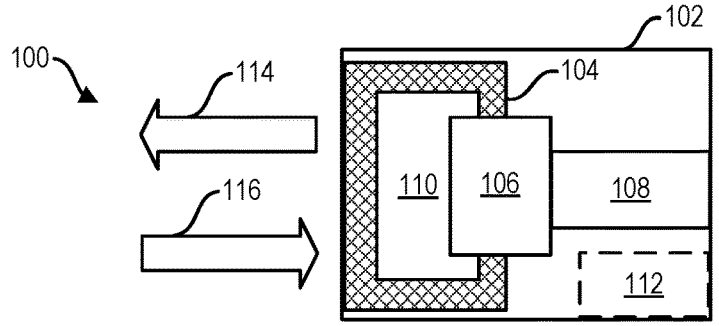
FIGS. 1A-1D are diagrams that illustrate an example of an electric power device with integrated safety measure.

Referring to FIGS. 1A-1D, diagrams of an electric power device 100 with integrated safety measure is shown. Electric power device includes a body 102, a casing 104, a receptacle 106, and a source connector 108. Body 102 makes up a body/housing of electric power device 100. In a particular implementation, body 102 is substantially cylindrical, as further described with reference to FIGS. 2A-2D and 3A-3G. In another particular implementation, body 102 is an outlet box, as further described with reference to FIGS. 4A-4E.

Receptacle 106 is configured to receive a plug (e.g., 120). For example, receptacle 106 may include one or more conductive members configured to physically couple to one or more conductive members of the plug. Source connector 108 is configured to be coupled to a power source (e.g., a generator, a transformer, an inverter, a battery, a solar panel, etc.). In some implementations, electric power device 100 further includes a power supply cord (not illustrated) including one or more conductors coupled to source connector 108. For example, the power supply cord may couple source connector 108 to the power source.

Casing 104 is coupled to body 102 and movable with respect to body 102 between a first position and a second position. FIG. 1A illustrates casing 104 in the first position. In the first position, casing 104 defines an enclosed chamber 110 and access to receptacle 106 is inhibited. For example, casing 104 may not be open such that a plug may be inserted—e.g., insertion of plug 120 into receptacle is prevent. In the second position, casing 104 is configurable to enable access to receptacle 106 for receipt of plug 120. For example, a portion of casing 104 may be rotated open or flexible portions of casing 104 may be spread apart, as further described herein.

Figure 1B:
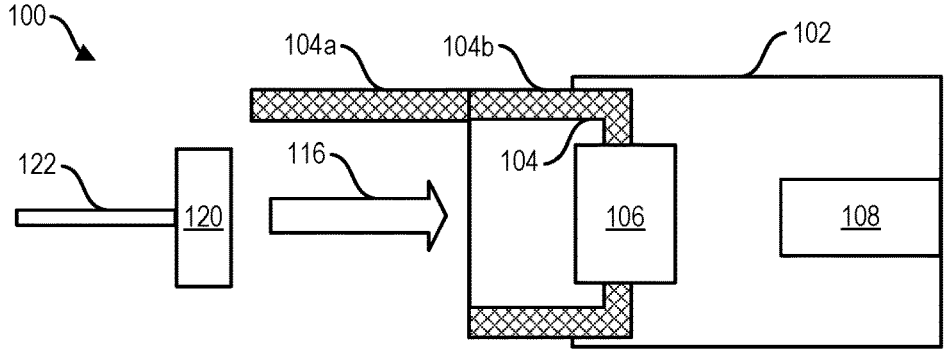

Casing 104 may be moved in multiple directions with respect to body 102. For example, casing 102 may be movable in a first direction 114. The first direction 114 may correspond to a transition from the first position (as illustrated in FIG. 1A) to the second position (as illustrated in FIG. 1B). As another example, casing 104 may be movable in a second direction 116. The second direction 116 is opposite to first direction 114 and may correspond to a transition from the second position to the first position.

In some implementations, electric device 100 also includes optional coupling device 112. Coupling device 112 may be configured to enable movement of casing 104 in first direction 114 with respect to the body, first direction 114 corresponding to the transition from the first position to the second position. Coupling device 112 may also be configured to enable movement of casing 104 in second direction 116 with respect to the body, second direction 116 corresponding to the transition from the second position to the first position. In some implementations, coupling device 112 may include a twist barrel or a lever, as illustrative, non-limiting examples. When coupling device 112 is a twist barrel, rotation of the twist barrel causes movement of casing 104 such that rotation in a first direction causes movement in first direction 114 and rotation in a second direction causes movement in second direction 116 (opposite of first direction 114). Details of the twist barrel are further described herein with reference to FIGS. 2A-2D and 3A-3G. When coupling device 112 is a lever, a first operation of the lever causes movement of casing 104 in first direction 114 with respect to body 102 and a second operation of the lever causes movement of casing 104 in second direction 116 with respect to body 102. Details of the lever are further described herein with reference to FIGS. 4A-4E.

FIG. 1B shows electric power device 100 with casing 104 in the second position. For example, casing 104 is moved in first direction 114 from the first position (as shown in FIG. 1A). A transition from the first position to the second position causes receptacle 106 to be electrically decoupled from source connector 108 when casing 104 is at the second position. For example, electrical conductors coupled to source connector 108 may be decoupled from receptacle 106 because moving casing 104 to the second position moves receptacle 106 away/apart from source connector 108.

When casing 104 is in the second position, casing 104 is configurable to enable access to receptacle 106. For example, chamber 110 may be open and available for a plug to be inserted into receptacle 106. To illustrate, casing 104 may include a first portion 104*a* and a second portion 104*b*. First portion 104*a* may be movable to enable access to receptacle 106, while second portion 104*b* may remain fixed to define an opening configured to receive a plug. In a particular implementation, first portion 104*a* may be rotated to enable access to receptacle 106, as further described herein with reference to FIGS. 2A-2D. In other implementations, first portion 104*a* and/or second portion 104*b* may correspond to one or more flexible portions of casing 104 that may be separated to enable access to receptacle 106, as further described herein with reference to FIGS. 3A-3G and 4A-4E.

As shown in FIG. 1B, a plug 120 may be moved in second direction 116 to couple plug 120 to receptacle 106. Plug 120 may include a cord 122 (e.g., an extension cord) coupled to plug 120 and configured to be coupled to an electronic device at a location away from electric power device 100. Plug 120 and a portion of cord 122 may be inserted into casing 104 to couple plug 120 to receptacle 106. For example, one or more conductors (e.g., prongs or blades) of plug 120 may be coupled to one or more conductors of receptacle 106.

Figure 1C:
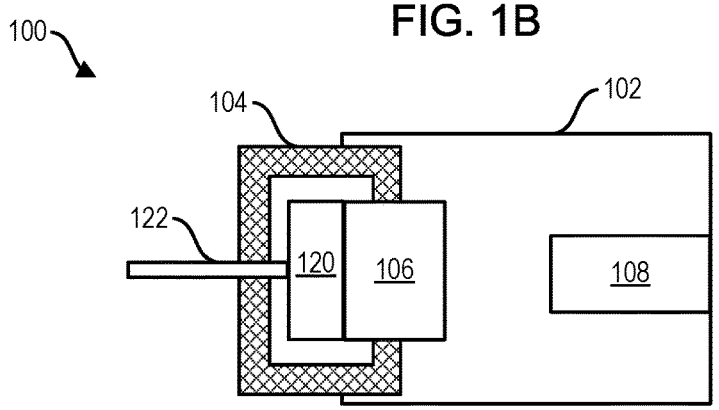

FIG. 1C illustrates electric power device 100 with casing 104 in the second position. In FIG. 1C, plug 120 is coupled to receptacle 106. Additionally, casing 104 is in a closed configuration, such that plug 120 and a portion of cord 122 are received within casing 104. Because casing 104 is closed, plug 120 is protected from weather conditions such as precipitation (e.g., rain, snow, etc.) or other moisture. However, to prevent a ground fault, and thus injury to a person, plug 120 is not coupled (via receptacle 106) to source connector 108 at this point. Instead, casing 104 is to be moved in second direction 116 to transition casing 104 from the second position to the first position.

Figure 1D:
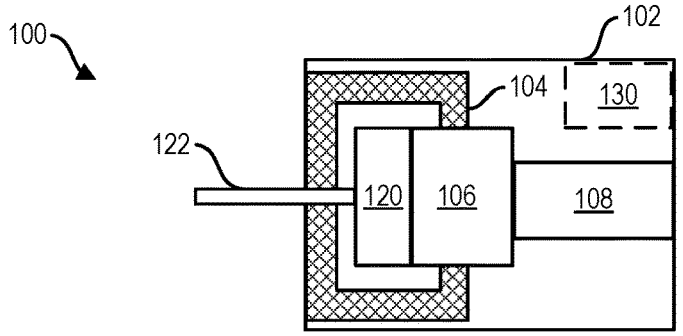

FIG. 1D illustrates electric power device 100 with casing 104 in the first position. From FIG. 1C to FIG. 1D, casing 104 is transitioned from the second position to the first position. Transitioning casing 104 from the second position to the first position causes receptacle 106 to be electrically coupled to source connector 108 when casing 104 is at the first position. Because plug 120 is coupled to receptacle 106, plug 120 is thus coupled to source connector 108, and if source connector 108 is coupled to a power source, current may flow from source connector 108, through receptacle 106 and plug 120, and to cord 122.

In some implementations, electric power device 100 may include one or more indicators 130. One or more indicators 130 may be configured to provide a first indication of an electrical state of source connector 108, a second indication of an electrical state of receptacle 106, or both. For example, one or more indicators 130 may include one or more light emitting diodes (LEDs), other lights that light up when power is connected to a respective component, a tactile indicator, an audio indicator, or a combination thereof. To illustrate, a first LED may light up when a power source is coupled to source connector 108 and may power down when no power source is coupled to source connector 108. As another example, a second LED may light up when receptacle 106 is coupled to source connector 108 (and receiving current) and may power down when receptacle 106 is not coupled to source connector 108. Thus, a user may be able to identify what electrical states receptacle 106 and/or source connector 108 are in based on one or more indicators 130.

In some implementations, at least a portion of body 102, casing 104, or both are transparent to enable plug 120 coupled to receptacle 106 to be visible while plug 120 is coupled to receptacle 106 when receptacle 106 is at the first position. For example, portions of body 102 and/or casing 104 may be made from a transparent material, such as plastic, glass, etc., that enables plug 120 to be visible when coupled to receptacle 106 while receptacle 106 is in the first position. In this manner, a user may be able to identify whether plug 120 is fully coupled to receptacle 106 when casing 104 is in the first position. In other implementations, casing 104 and body 102 are not transparent, and a user may ascertain the electrical states of the interior components via one or more indicators 130.

It is noted that in some implementations, receptacle 106 may be configured such that one or more portions of plug 120 are inserted into and received by receptacle 106 to electrically couple receptacle 106 and plug 120. In other implementations, receptacle 106 and plug 120 may be configured such that one or more portions of receptacle 106 are inserted into and received by plug 120.

Thus, FIGS. 1A-1D describe electric power device 100 with one or more integrated and/or unitary safety measures. For example, casing 104 and body 102 operate to form an enclosed chamber that protects plug 120 from precipitation, such as rain or snow, or other moisture. Additionally, because casing 104 is in the second position when plug 120 is coupled to receptacle 106, receptacle 106 is not coupled to source connector 108 when plug 120 is inserted into receptacle 106. Instead, receptacle 106 is only coupled to source connector 108 when casing 104 is at the second position (e.g., after insertion of plug 120 in receptacle 106). Thus, a danger of electrical shock to a user is prevented.

Figure 2A:
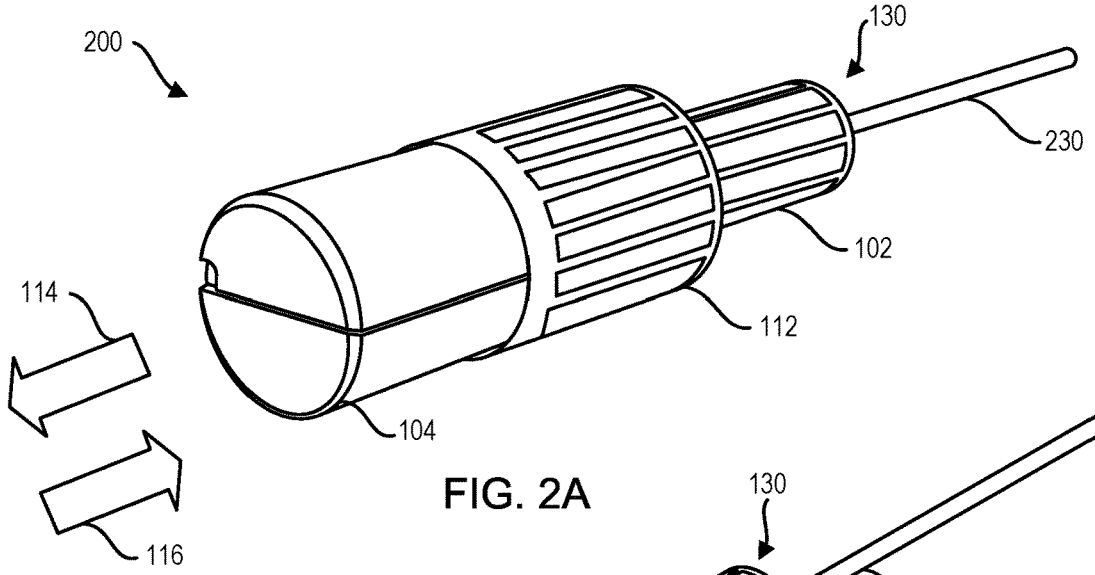
FIGS. 2A-2K are diagrams of a first implementation of the electric power device of FIG. 1.
Figure 2B:
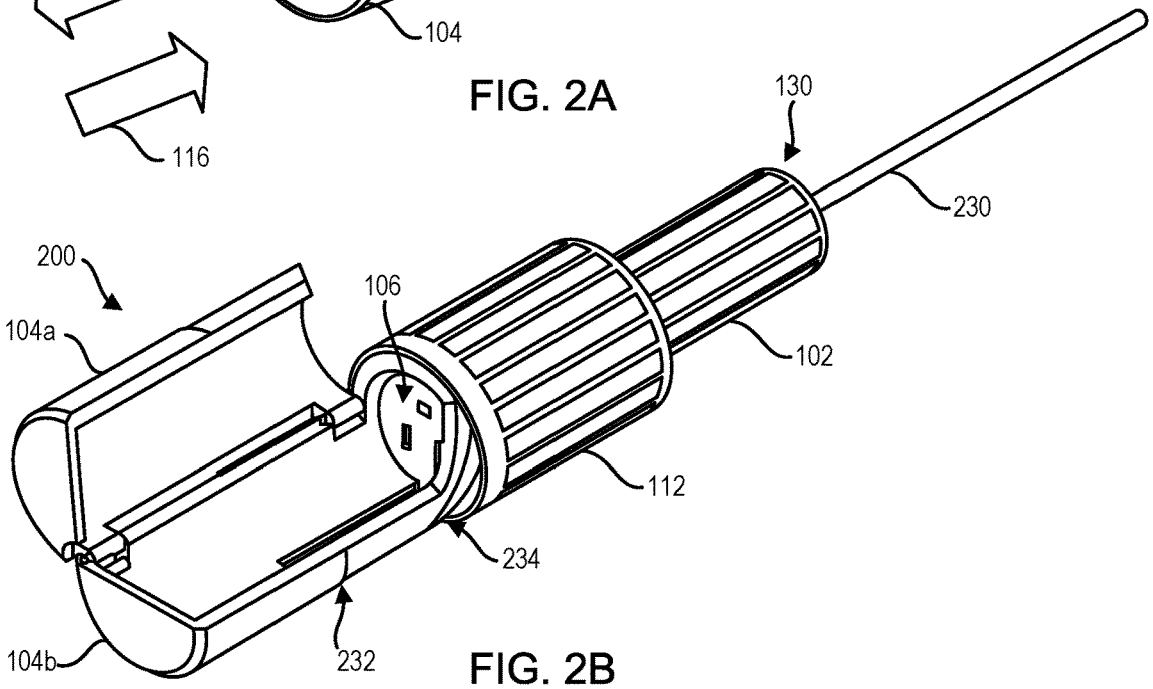
Figures 2C, 2D:
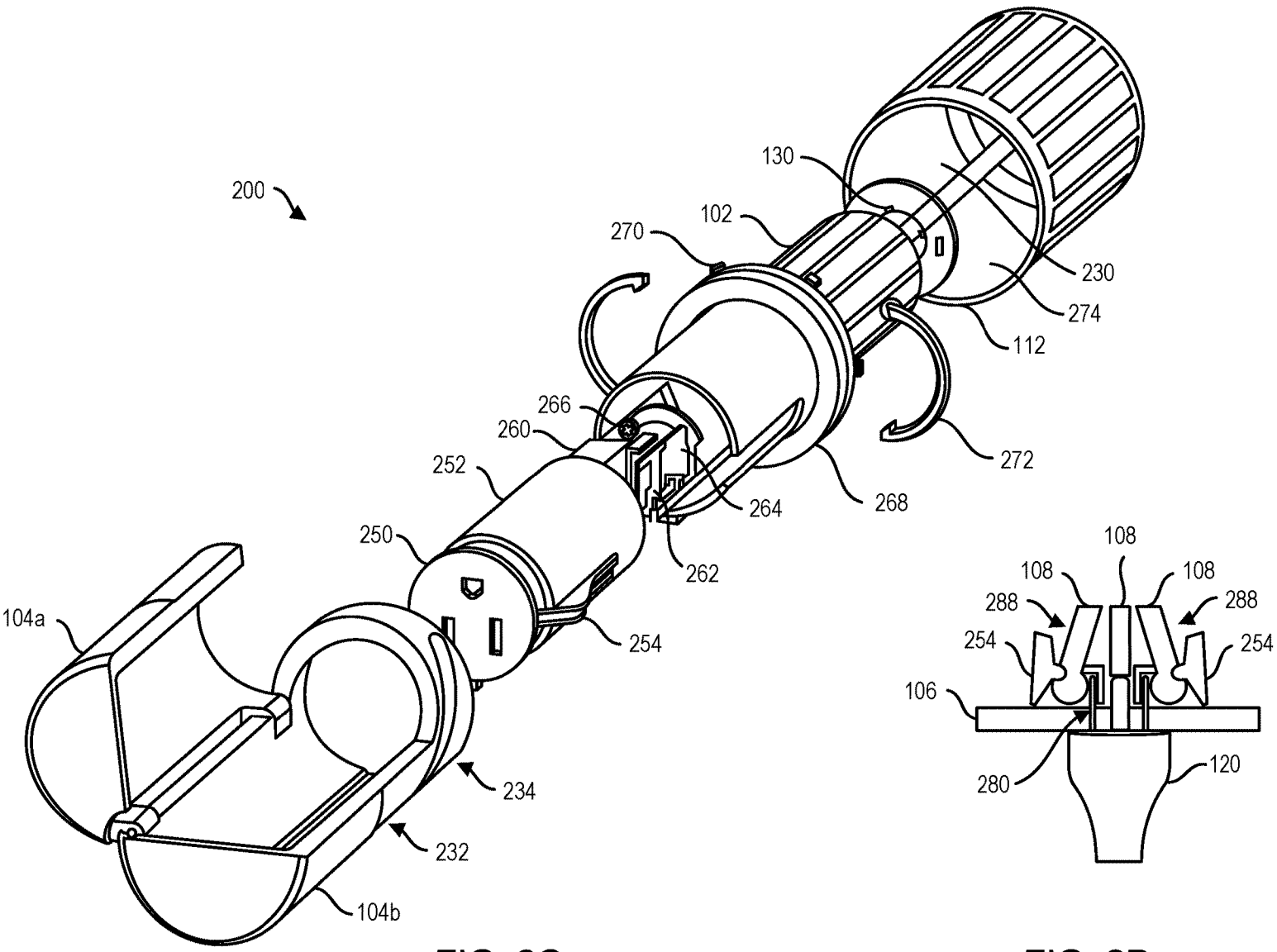
Figure 2E:
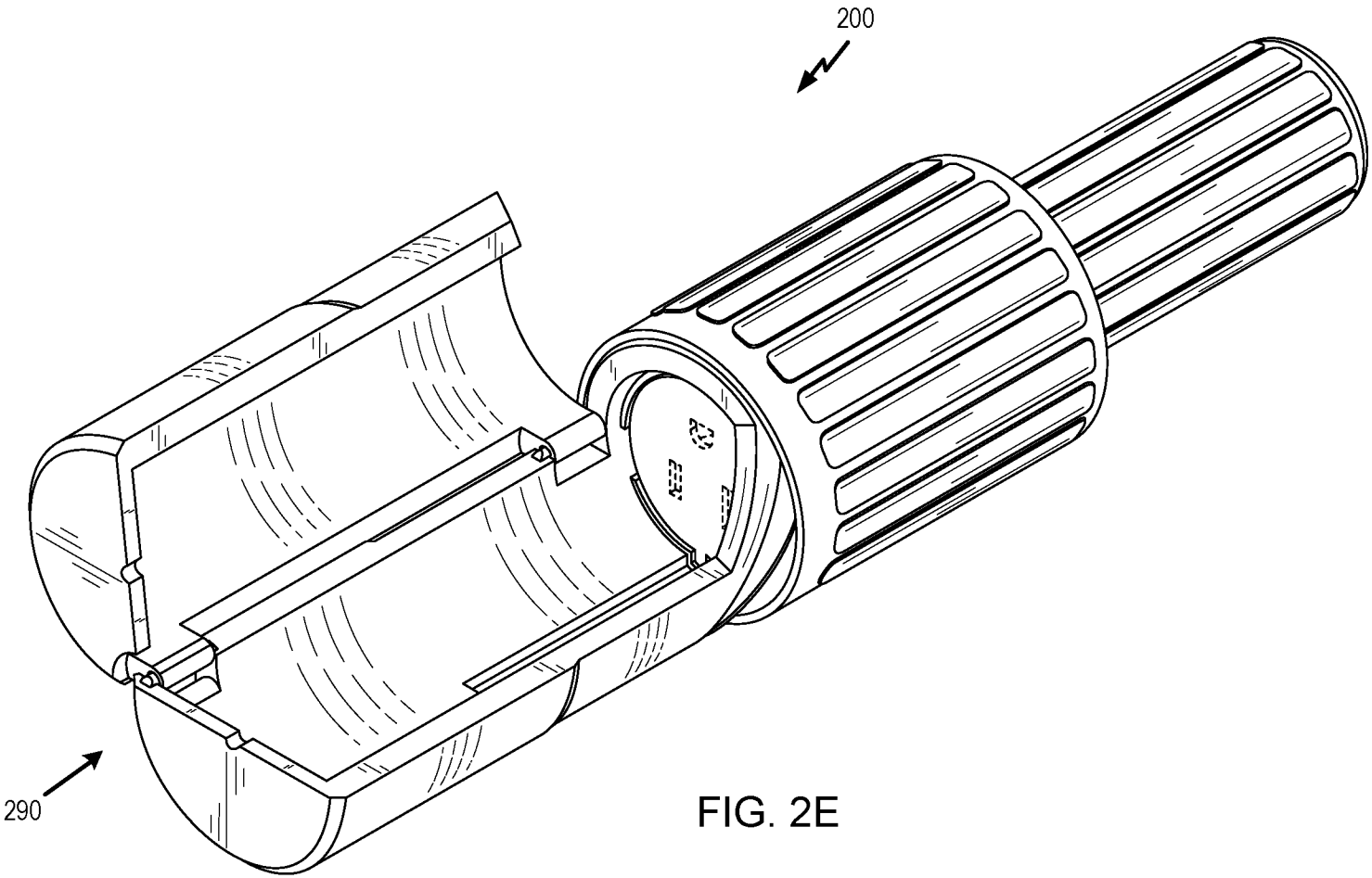
Figure 2F:
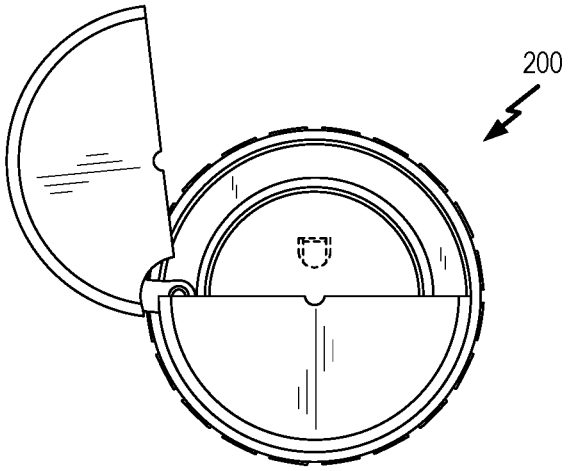
Figure 2G:
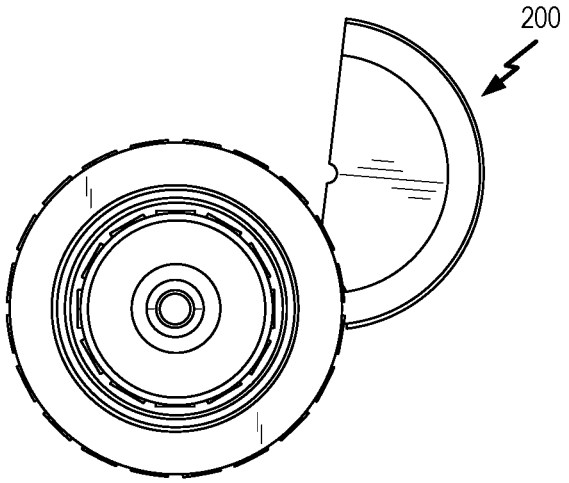
Figure 2H:
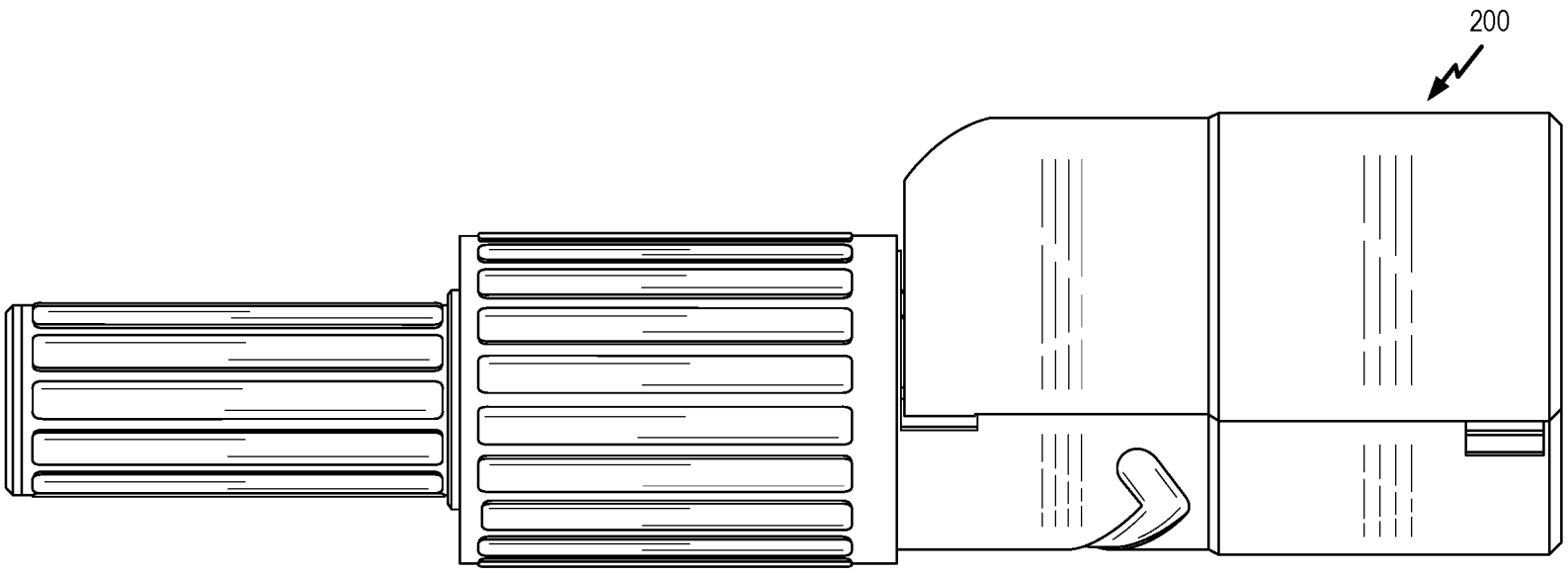
Figure 2I:
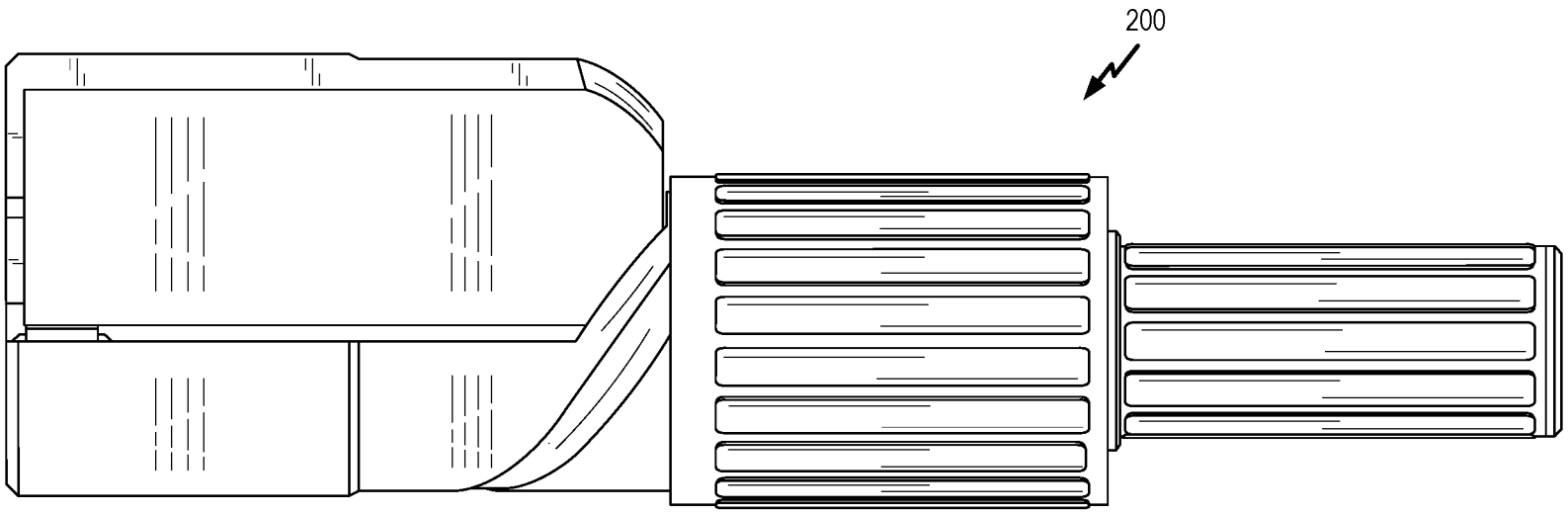
Figure 2J:
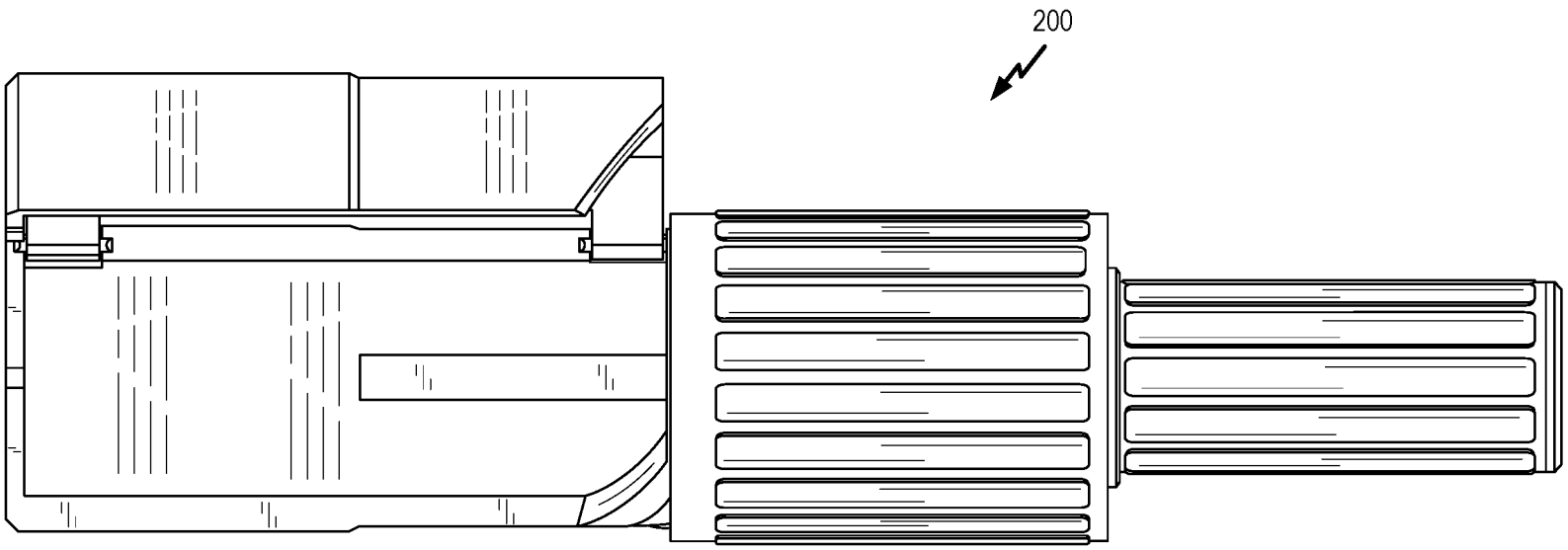
Figure 2K:
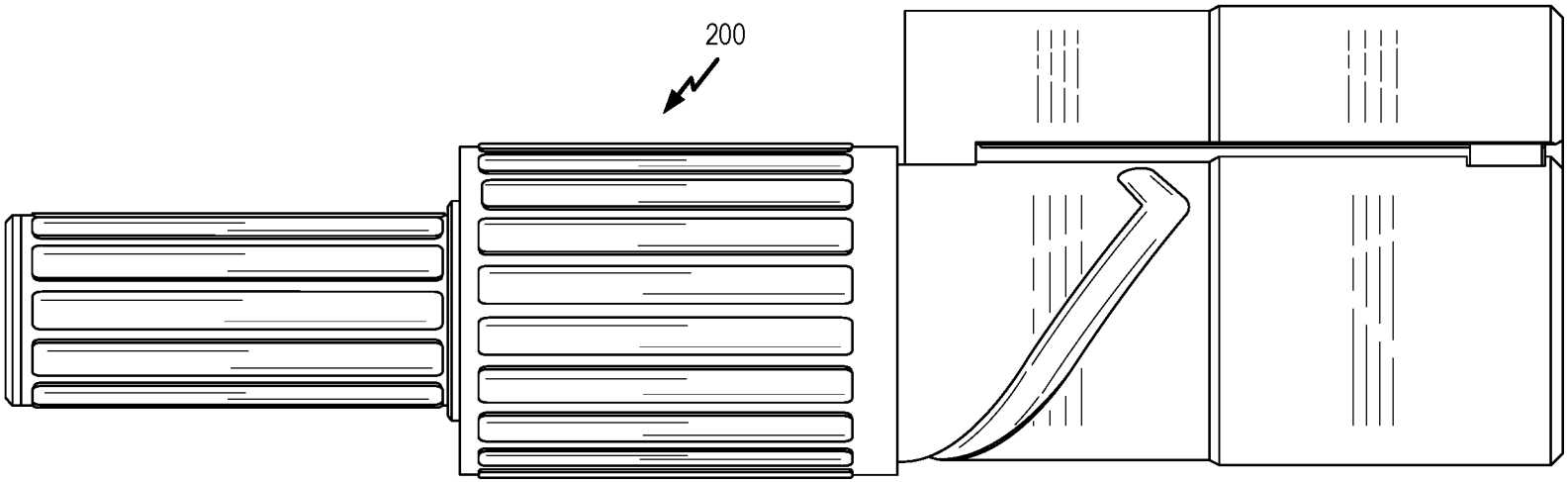

Referring to FIGS. 2A-2K, a first implementation of an electric power device 200 is shown. The electric power device 200 may include or correspond to the electric power device 100 of FIGS. 1A-1D. FIG. 2A shows a perspective view of electric power device 200, FIG. 2B shows another perspective view of electric power device 200, FIG. 2C shows an assembly drawing of electric power device 200, and FIG. 2D shows a detail view of one or more components to illustrate coupling of receptacle 106 to a source connector (e.g., 108). FIG. 2E shows a perspective view of electric power device 200, FIG. 2F shows a front view of electric power device 200, FIG. 2G shows a rear view of electric power device 200, FIG. 2H shows a rear view of electric power device 200, FIG. 2I shows a front view of electric power device 200, FIG. 2J shows a top view of electric power device 200, FIG. 2K shows a bottom view of electric power device 200.

Referring to FIG. 2A, a first view of electric power device 200 is shown. In FIG. 2A, casing 104 is in the first position. Movement of casing 104 may be controlled by coupling device 112. For electric power device 300, coupling device 112 is a twist barrel. For example, the twist barrel may be rotated in various directions (e.g., clockwise or counterclockwise) about body to move casing 104 in various directions. In some implementations, electric power device includes one or more connectors 230 coupled to source connector 108.

Referring to FIG. 2B, a second view of electric power device 200 is shown. In FIG. 2B, casing 104 is in the second position. Casing 104 may be transitioned to the second position by moving casing 104 in first direction. Moving casing 104 in first direction 114 may be achieved by rotating coupling device 112 (e.g., twist barrel) in a first rotational direction (e.g., counterclockwise). Moving casing 104 in this direction extends casing 104 from body 102. Casing 104 may include a first portion 104*a* and a second portion 104*b*. When casing is in the second position, portions 104*a* may be rotated with respect to portion 104*b* to enable access to receptacle 106. After rotating first portion 104*a* from second portion 104*b*, plug 120 and cord 122 may be moved in second direction 116 to couple plug 120 to receptacle 106. Although described as first portion 104*a* rotating with respect to second portion 104*b* (e.g., via one or more hinges, in other implementations, first portion 104*a* may move relative to second portion 104*b* in another matter, such as by disengaging, pivoting, sliding, etc., to enable access to receptacle 106.

As show in FIG. 2B, casing 104 includes a groove or channel 234 to engage and/or interact with a portion of coupling device 112 to enable/cause movement of casing 104 responsive to movement of coupling device 122. Additionally, casing 104 includes a ridge 232 that in some implementations is configured to contact coupling member 112 when casing is in the first position. As shown in FIGS. 2E-2K, electronic power device may include one or more channels in casing to accommodate a cable of a plug to be inserted into receptacle 106.

Referring to FIG. 2C, an assembly drawing of electric power device 200 is shown. Electric power device 200 includes casing 104, a receptacle cover 250, a receptacle housing 252, one or more flex springs 254. Receptacle housing 252 is configured to cover/house receptacle 106, which in some implementations, may include receptacle cover 250. Each of the one or more flex springs 254 (e.g., on or more flex spring arms) is configured to be biased toward a position in which receptacle 106 is electrically decoupled from source connector 108. As described further herein at least with reference to FIG. 2D, movement of casing 104 from the second position to the first position causes casing 104 to engage one or more flex springs 254 coupled to the source connector 108 such that, when casing 104 is at the second position, the one or more flex spring 254 cause receptacle 106 to be electrically coupled to source connector 108.

Electronic device further includes an indicator driver 260, an AC/DC converter 262, an indicator printed circuit board (PCB) 264 including indicator control circuitry, a PCB mount screw 266. The indicator driver 260 may be coupled to one or more indicators 130. AC/DC convert 262 may be coupled to source connector 108 and/or one or more connectors 230. Body 102 may include a flange 270 that is configured to be coupled to and/or retain at least a portion of coupler device 112. For example, flange 270 may retain coupler device 112 using one or more ring coupling components 272. A cover, such as an indicator cover may be coupled to body 112.

Referring to FIG. 2D, plug 120 is inserted into receptacle 106 such that prongs/blades 280 are inserted into and retained by/coupled to conductive clips of receptacle 106. As shown in FIG. 2D, flex spring arms 254 have been moved by casing 104 as indicated by arrows 288 to move portions or members of source connector 108 into electrical contact with receptacle 106—e.g., in contact with clips of receptacle. The portions or members of source connector 108 be coupled to flex spring 254 and/or may be biased to be decoupled from receptacle 106 (e.g., clips of receptacle). Although FIG. 2D shows and identifies portions or members of source connector 108, in some implementations, the portions or members may include one or more conductive members that are distinct from source connector 108. For example, the portions or members may be part of receptacle 106. As another example, the portions or members may be distinct from each of receptacle 106 and source connector 108 and may be configured to form an electrical connection between receptacle 106 and source connector 108.

In the implementation illustrated in FIG. 2A, plug 120 is coupled to receptacle 106, as evidenced by cord 122 being inserted in casing 104. Because plug 120 is in chamber 110, plug 120 is protected from the moisture surrounding electric power device 300.

Thus, FIGS. 2A-2D describe electric power device 200, which acts as a safe extension cord (a "hideout safe extension cord"). For example, casing 104 and body 102 shelters and seals the connection point between an extension cord (e.g., plug 120) and receptacle 106 to protect the connection point from moisture. It may also facilitate an unbreakable connection point where the two points come together, such that tying two cords together is no longer needed. To protect the user, power is not activated (e.g., provided to plug 120) until plug 120 is engaged in receptacle 106 and both are pushed back and sealed in casing 104.

Referring to FIGS. 3A-3G, a second implementation of an electric power device 300 is shown. The electric power device 300 may include or correspond to the electric power device 100 of FIGS. 1A-1D.

Figure 3A:
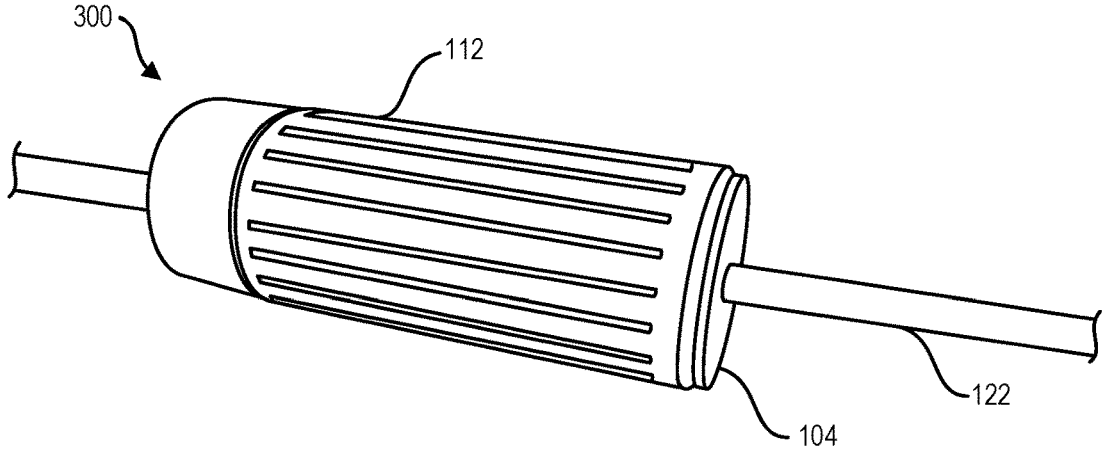
FIGS. 3A-3J are diagrams of a second implementation of the electric power device of FIG. 1.

Referring to FIG. 3A, a first view of electric power device 300 is shown. In FIG. 3A, casing 104 is in the first position. Movement of casing 104 may be controlled by coupling device 112. For electric power device 300, coupling device 112 is a twist barrel. For example, the twist barrel may be rotated in various directions (e.g., clockwise or counterclockwise) about body to move casing 104 in various directions. In the implementation illustrated in FIG. 3A, plug 120 is coupled to receptacle 106, as evidenced by cord 122 being inserted in casing 104. Because plug 120 is in chamber 110, plug 120 is protected from the moisture surrounding electric power device 300.

Figure 3B:
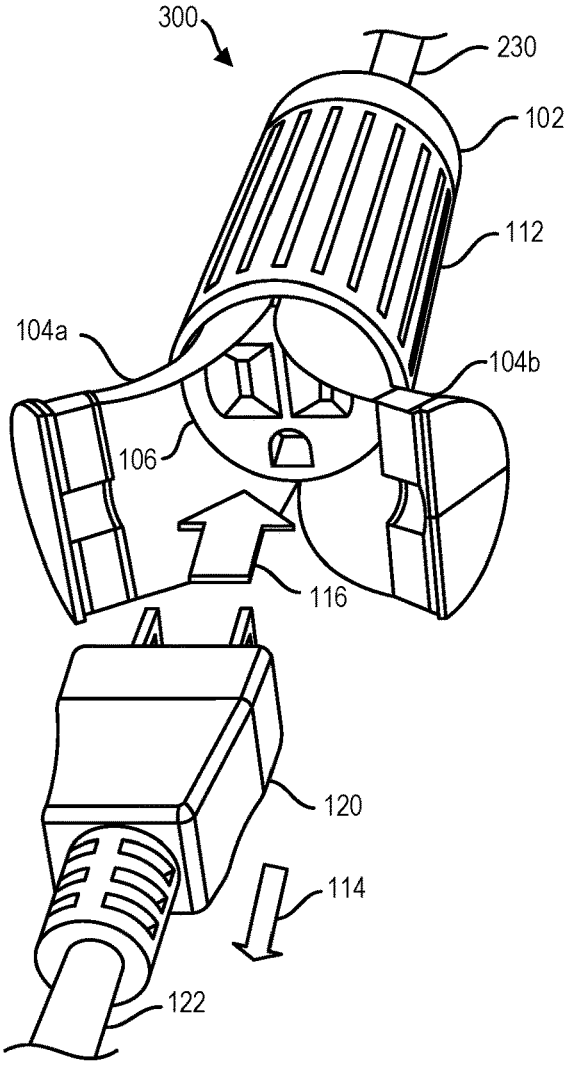

Referring to FIG. 3B, a second view of electric power device 300 is shown. In FIG. 3B, casing 104 is in the second position. Casing 104 may be transitioned to the second position by moving casing 104 in first direction 114. Moving casing 104 in first direction 114 may be achieved by rotating coupling device 112 (e.g., twist barrel) in a first rotational direction (e.g., counterclockwise). Moving casing 104 in this direction extends casing 104 from body 102 and enables access to receptacle 106. For example, casing 104 may include a first portion 104*a* and a second portion 104*b*. Portions 104*a* and 104*b* may be flexible portions that may be separated to enable access to receptacle 106. After separating first portion 104*a* from second portion 104*b*, plug 120 and cord 122 may be moved in second direction 116 to couple plug 120 to receptacle 106.

Figure 3C:
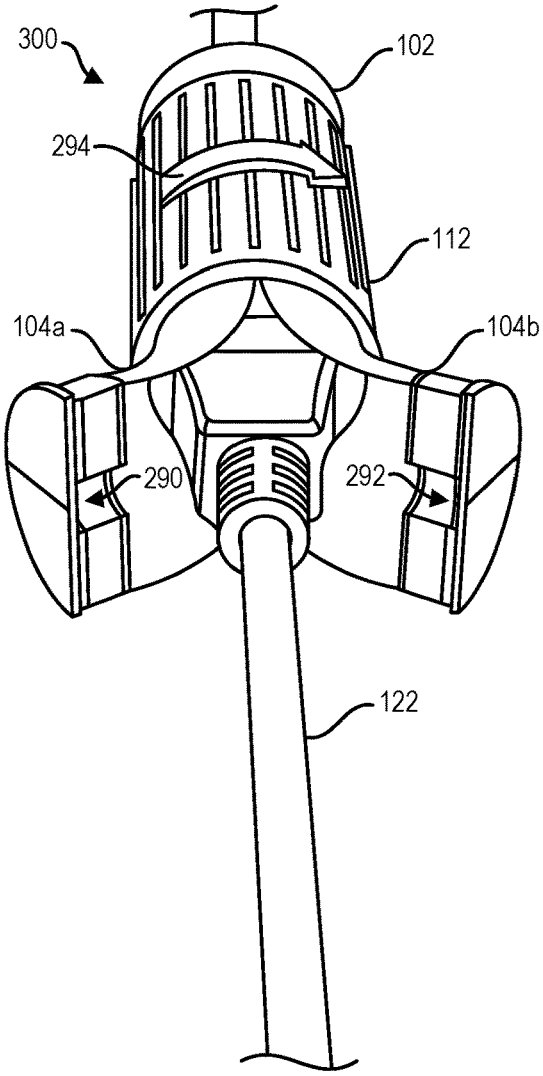

Referring to FIG. 3C, a third view of electric power device 300 is shown. In FIG. 3C, plug 120 has been coupled to receptacle 106. Additionally, casing 104 may have grooves and/or channels configured to surround cord 122 to seal cord 122 and plug 120 from moisture. For example, first portion 104*a* may include first groove 290, and second portion 104*b* may include second groove 292. Grooves 290-292 may be configured to surround a portion of cord 122 after plug 120 has been coupled to receptacle 106 and first portion 104*a* and second portion 104*b* have been pushed together.

To transition casing 104 to the first position, coupling device 112 (e.g., twist barrel) may be rotated in second rotational direction 294 (e.g., clockwise). Rotating coupling device 112 in second rotational direction 294 may move casing 104 relative to body 102 such that casing 104 no longer extends from body 102 (e.g., from coupling device 112).

Figure 3D:
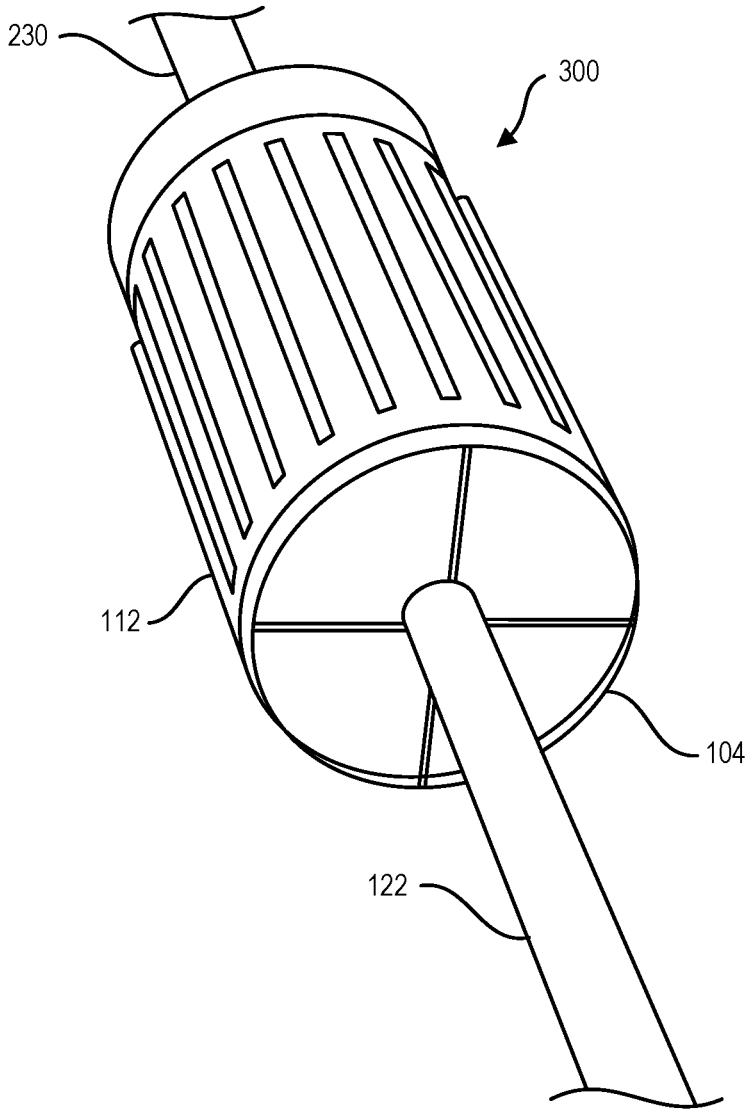

Referring to FIG. 3D, a fourth view of electric power device 300 is shown. In FIG. 3D, casing 104 has been transitioned to the first position (e.g., via rotation of coupling device 112). At this point, receptacle 106 may be coupled to source connector 108. In a particular implementation, body 102 and casing 104 are completely covered by coupling device 112. As shown in FIG. 3D, only cord 122 and a cord 230 (e.g., a cord having one or more conductors coupled to source connector 108) are visible as extending from electric power device 300.

Figure 3E:
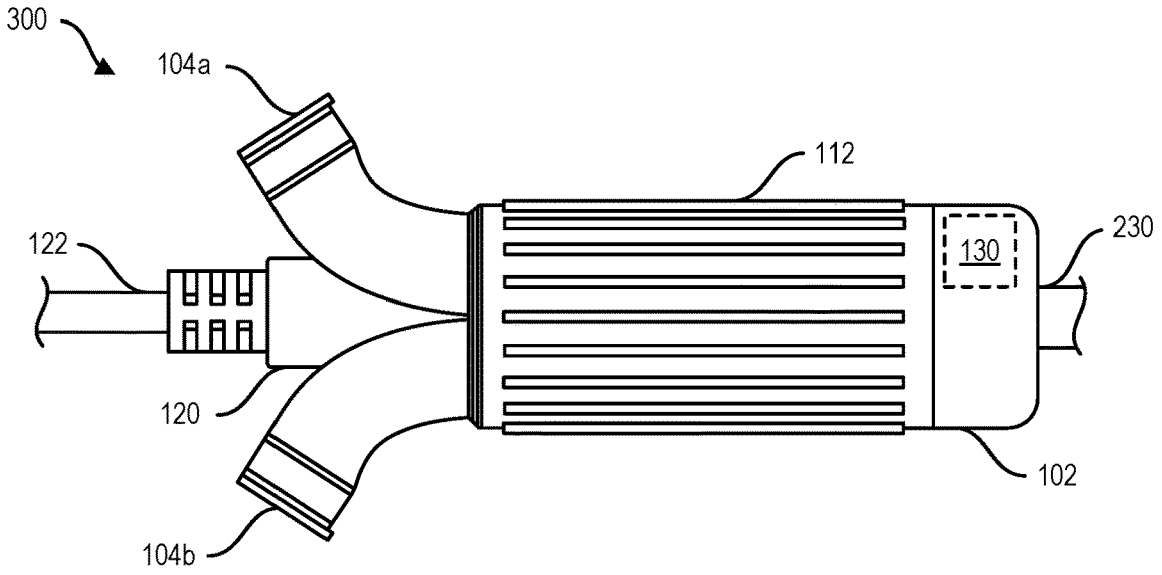

Referring to FIG. 3E, a fifth view of electric power device 300 is shown. FIG. 3E depicts a situation similar to FIG. 3C. For example, plug 120 has been coupled to receptacle 106. At this point, casing 104 may be transitioned from the second position to the first position by rotation of coupling device 112. Additionally, FIG. 3E shows optional one or more indicators 130, which may indicate the electrical states of receptacle 106, source connector 108, or both, as described with reference to FIG. 1D.

Figure 3F:
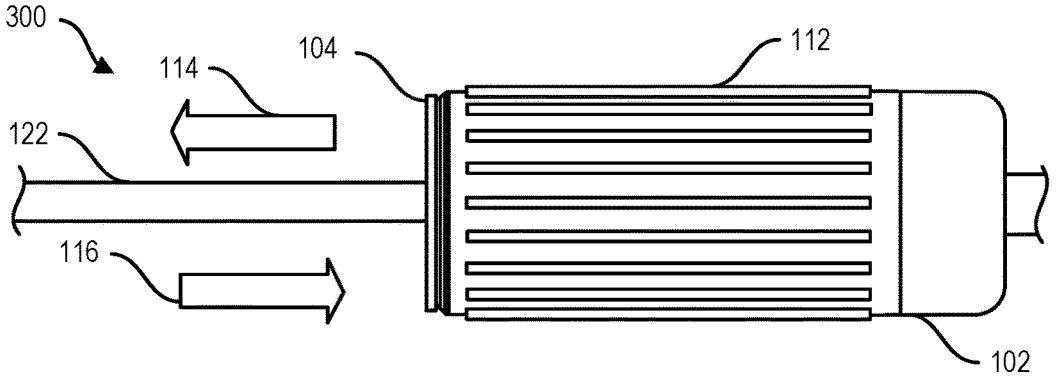

Referring to FIG. 3F, a sixth view of electric power device 300 is shown. In FIG. 3F, casing 104 may be moved in first direction 114 by rotation of coupling device 112 in the first rotational direction, or moved in second direction 116 by rotation of coupling device 112 in the second rotational direction. Rotating coupling device 112 in the second rotational direction transitions casing 104 from the first position to the second position. In a particular implementation, a click will sound when casing 104 is in the first position.

Figure 3G:
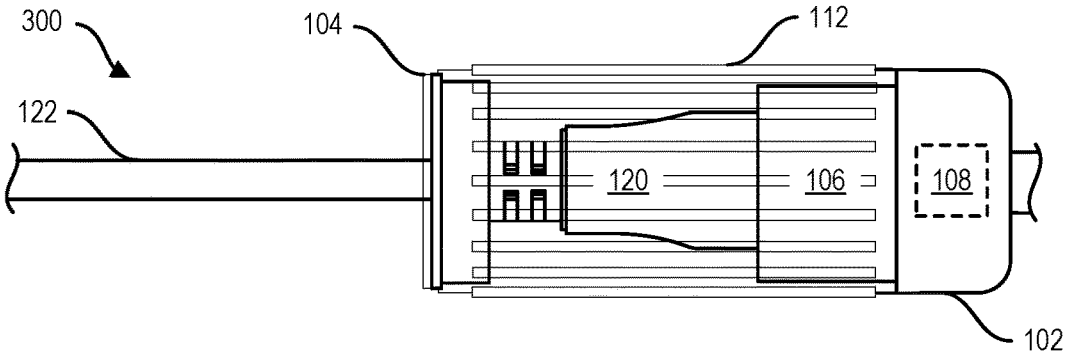

Referring to FIG. 3G, a seventh view of electric power device 300 is shown. In FIG. 3G, casing 104 is in the first position such that receptacle 106 (and plug 120) are coupled to source connector 108. Coupling plug 120 to receptacle 106 and receptacle 106 to source connector 108 provides current to cord 122 (and to an electronic device coupled to cord 122). As shown in FIG. 3G, at least a portion of coupling device 112 and/or body 102 are depicted as being transparent to enable a user to view cavity/chamber 110.

Figure 3H:
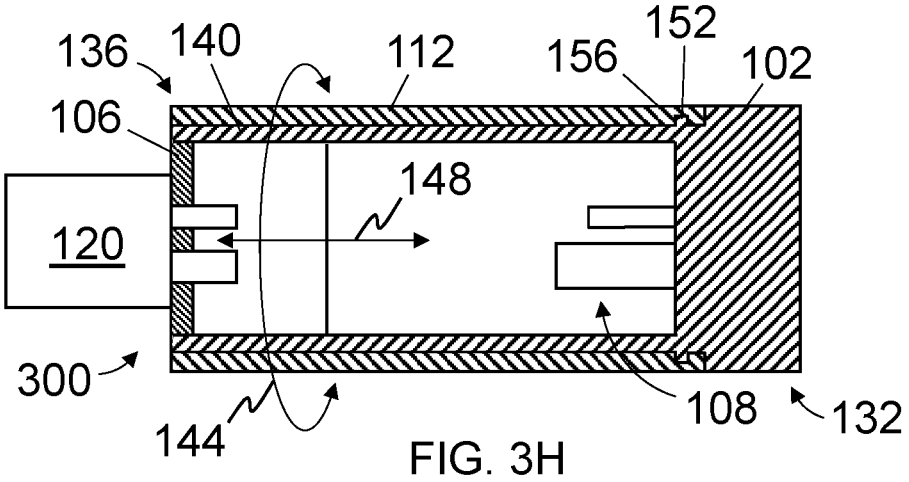
Figure 3I:
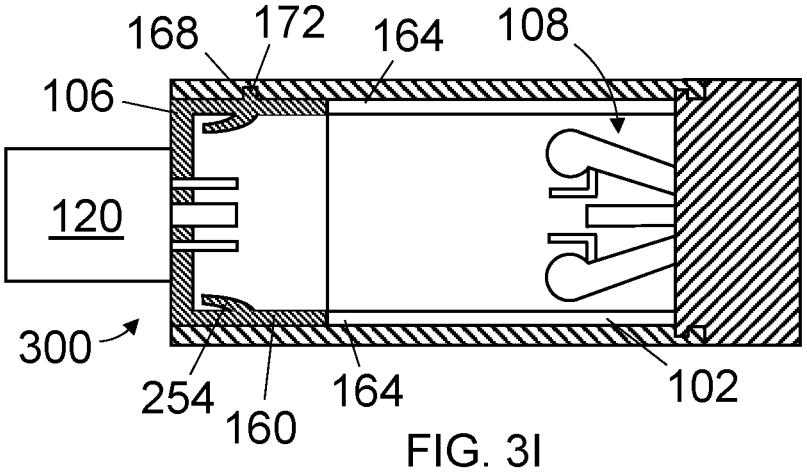
Figure 3J:
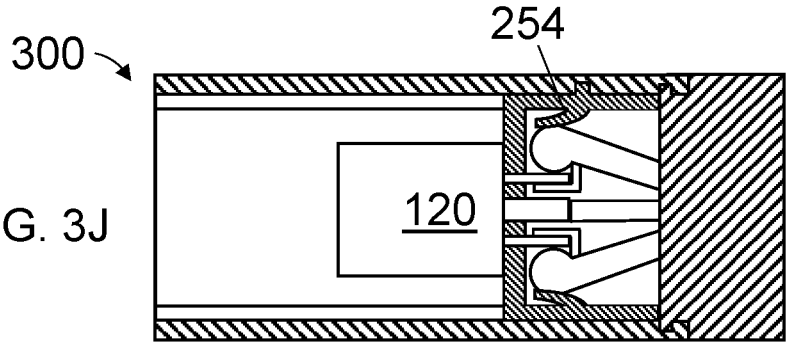

FIGS. 3H-3J illustrate one non-limiting way in which electric power device 300 can operate, where each of FIGS. 3H-3J is a lengthwise, partially cross-sectional, and schematic (not drawn to scale) view of the device, FIGS. 3I's and 3J's being taken in a first plane, and FIG. 3H's being taken in a second plane that is perpendicular to the first plane. Coupling device 112 (e.g., a twist barrel) can be rotatable relative to body 102. To illustrate, body 102 can have a first end 132 and a second end 136, and the body can define an inner (with respect to device 300) sleeve 140 that extends from—but is not necessarily disposed at—the first end and to the second end. And coupling device 112 can be rotatably disposed around (e.g., in contact with) sleeve 140 such that, for example, the coupling device is rotatable relative to the sleeve in direction 144. In order to restrict translation of coupling device 112 relative to body 102 (e.g., in direction 148), which might otherwise cause inadvertent separation of the coupling device and the body, the body can define one or more protrusions and/or one or more recesses that are received by and/or receive, respectively, one or more recesses and/or one or more protrusions defined by the coupling device. To illustrate, body 102 can define a circumferential ridge 152 that is receivable by a circumferential groove 156 of coupling device 112.

Receptacle 106 can be translatable (e.g., in direction 148) relative to body 102 between a first position (FIGS. 3H and 3I) and a second position (FIG. 3J) in which the receptacle is closer to first end 132 of the body than when the receptacle is in the first position. When receptacle 106 is in the first position, it can receive a plug (e.g., 120), and the receptacle can then be moved to the second position to enable current to flow through the plug via, for example, electrical communication between the plug and source connector 108, which can be disposed at or near first end 132. Such a configuration can provide enhanced safety given that current need not flow through the plug when it is initially inserted into receptacle 106. Instead, such flow can occur after the plug and receptacle are moved to a (e.g., more remote, relative to the user) location.

For example, receptacle 106 can be slidably disposed within body 102's sleeve 140. In order to restrict rotation of receptacle 106 relative to body 102, which might—in some embodiments—otherwise cause misalignment of the plug and source connector 108, the receptacle can define one or more protrusions and/or one or more recesses that are received by and/or receive, respectively, one or more recesses and/or one or more protrusions defined by sleeve 140. To illustrate, receptacle 106 can define one or more ridges 160, each of which is receivable by a slot 164 defined by sleeve 140. In addition to guiding movement of receptacle 106 relative to body 102, sleeve 140 can shield the receptacle when the receptacle is in the second position (e.g., and source connector 108) from user-contact, dirt, moisture, and/or the like, enhancing the above-described safety benefits and/or promoting a strong connection through which current can flow through the plug. While not depicted in FIGS. 3H-3J, casing 104 can be coupled to receptacle 106 such that the casing extends outwardly of sleeve 140 when the receptacle is in the first position and is retracted into the sleeve as the receptacle is moved toward the second position.

Rotation of coupling device 112 relative to body 102 can cause translation of receptacle 106 relative to the body. To illustrate, coupling device 112 can define a helical groove 168 within which a protrusion 172 attached to receptacle 106 can be received. To permit such receipt of protrusion 172 by helical groove 168 through sleeve 140, the sleeve can define a slot (e.g., a slot 164, as shown). In this way, as coupling device 112 is rotated relative to body 102, and given that receptacle 106 is constrained from rotating relative to the body, protrusion 172 can be urged along helical groove 168 to translate the receptacle relative to the body between the first and second positions.

Similarly to as described above for device 200, device 300 can include one or more flex springs 254 for electrically coupling and decoupling the plug and source connector 108. To illustrate, flex spring(s) 254 can be coupled to receptacle 106 such that, as the receptacle reaches the second position, the flex spring(s) engage source connector 108 to enable electrical communication between the receptacle and the source connector. The flex spring(s) can, for example, deform one or more members of source connector 108 to bring about electrical communication (e.g., contact) between those member(s) and receptacle 106 (e.g., clip(s) thereof) and/or the plug (e.g., prong(s) thereof, if the plug is inserted into the receptacle). As used in this disclosure, a receptacle (e.g., 106) and a source connector (e.g., 108) are in electrical communication with, or electrically coupled to, one another if—but not only if—a plug (e.g., 120) inserted into the receptacle would be in electrical communication with the source connector. In some embodiments, one or more (e.g., relatively inflexible) protrusions can be substituted for flex spring(s) 254, and such protrusion(s) can contact and deform member(s) of source connector 108 to bring about electrical communication between the source connector and receptacle 106. In yet other embodiments, such flex spring(s) 254 and protrusion(s) can be omitted, and receptacle 106 and source connector 108 can be configured (e.g., sized and positioned) such that movement of the receptacle to the second position alone enables electrical communication between the receptacle and the source connector.

In some embodiments that are otherwise similar to that of FIGS. 3H-3J, a coupling device (e.g., 112) need not be rotatable relative to body 102. To illustrate, the coupling device can be a slider (or other structure) that is user-accessible from an exterior of body 102 and is translatable relative to the body (e.g., in direction 148). Such a slider can, for example, be coupled to receptacle 106 such that translation of the slider relative to body 102 can cause translation of the receptacle relative to the body between the first and second positions. And, in some embodiments that are otherwise similar to that of FIGS. 3H-3J, source connector 108 (or components thereof) can be attached to receptacle 106 rather than to body 102. In such embodiments, flex spring(s) 254 or their substitute protrusion(s) can be attached to body 102; for example, such flex spring(s) or protrusion(s) can extend from an inner surface of sleeve 140.

Thus, FIGS. 3A-3J describe electric power device 300, which acts as a safe extension cord (a "hideout safe extension cord"). For example, casing 104 and body 102 shelters and seals the connection point between an extension cord (e.g., plug 120) and receptacle 106 to protect the connection point from moisture. It may also facilitate an unbreakable connection point where the two points come together, such that tying two cords together is no longer needed. To protect the user, power is not activated (e.g., provided to plug 120) until plug 120 is engaged in receptacle 106 and both are pushed back and sealed in casing 104.

Referring to FIGS. 4A-4E, a third implementation of an electric power device 400 is shown. The electric power device 400 may include or correspond to the electric power device 100 of FIGS. 1A-1D.

Figure 4A:
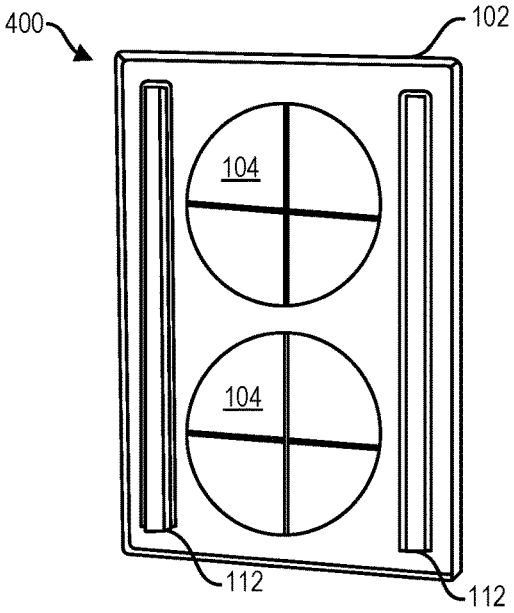
FIGS. 4A-4E are diagrams of a third implementation of the electric power device of FIG. 1.

Referring to FIG. 4A, a first view of electric power device 400 is shown. In this implementation, electric power device 400 includes a body 102 and two casings 104. Body 104 is an outlet box in this implementation. Additionally, electric power device includes two coupling devices 112, one corresponding to each casing. Coupling devices 112 are levers in this implementation. In FIG. 4A, casings 104 are both in the first position. Because no plug is plugged in, power is deactivated and live components are not accessible. Electrical states of receptacle 106 and source connector 108 may be shown by one or more indicators 130, such as LEDs, lights, etc. Although shown as having two casings 104, in other implementations, body 102 may include a single casing 104 or more than two casings 104, such as three or more casings 104.

Figure 4C:
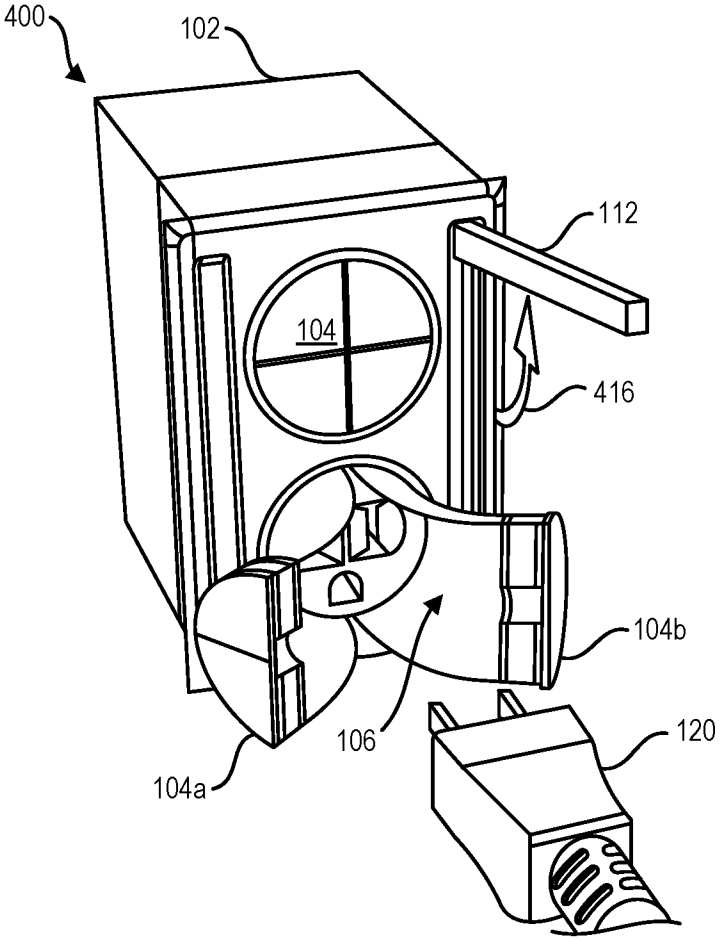
Figure 4B:
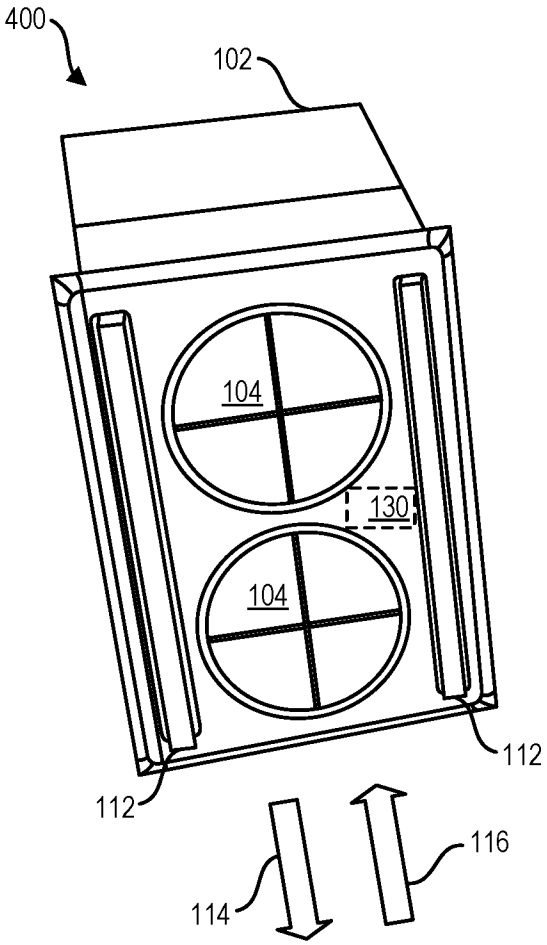

Referring to FIG. 4B, a second view of electric power device 400 is shown. Similar to FIG. 4A, FIG. 4B shows electric power device 400 with casings 104 in the first position. Casings 104 may be moved in first direction 114 or second direction 116 by manipulation of the corresponding coupling device 112 (e.g., lever).

Referring to FIG. 4C, a third view of electric power device 400 is shown. In FIG. 4C, coupling device 112 has been moved in first direction 416 (e.g., away from body 102) to move casing 104 to the second position. At the second position, casing 104 extends from body 102. Additionally, casing 104 includes a first portion 104*a* and a second portion 104*b*. Portions 104*a* and 104*b* form a flexible seal and can be separated to enable access to receptacle 106. Once separated, plug 120 may be plugged into receptacle 106.

Figure 4E:
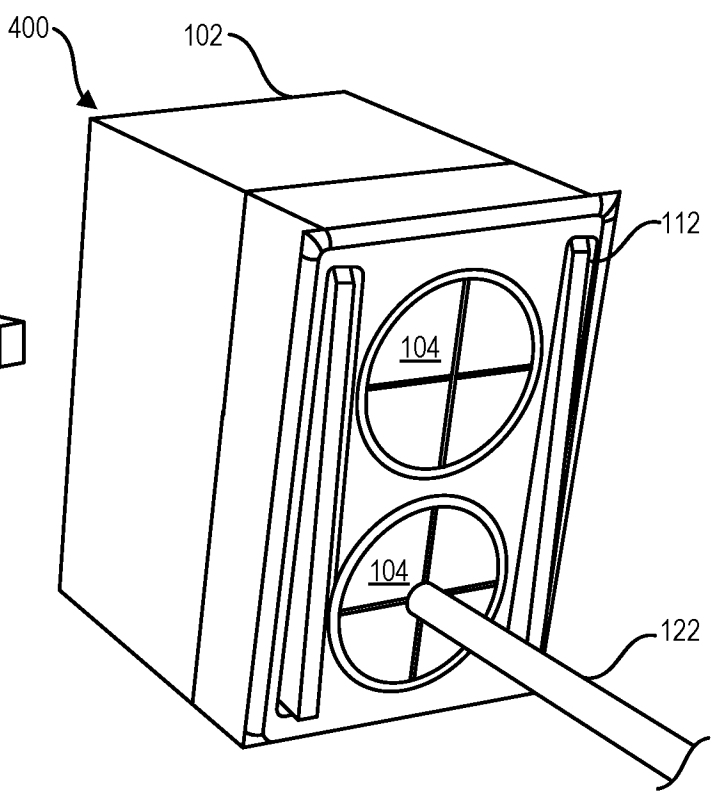
Figure 4D:
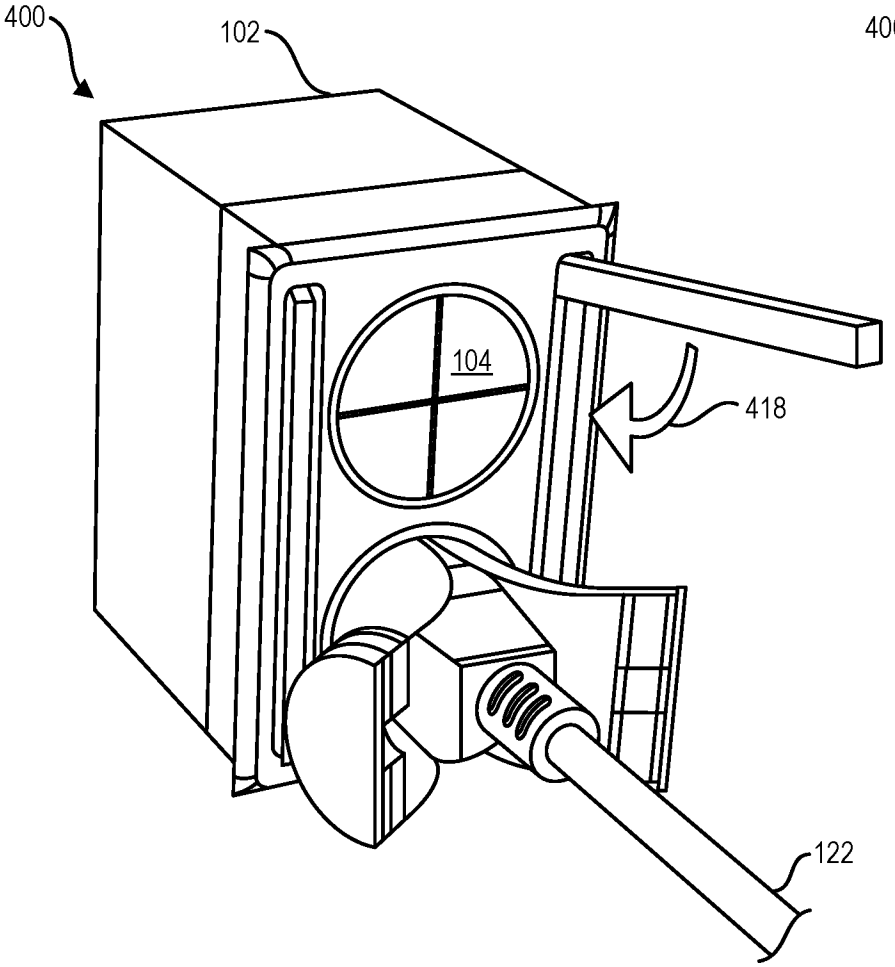

Referring to FIG. 4D, a fourth view of electric power device 400 is shown. In FIG. 4D, plug 120 is coupled to receptacle 106. To transition casing 104 to the first position, coupling device 112 (e.g., lever) may be moved in second direction 418 (e.g., toward body 102). Moving coupling device 112 in second direction 418 may move casing 104 relative to body 102 such that casing 104 no longer extends from body 102.

Referring to FIG. 4E, a fifth view of electric power device 400 is shown. In FIG. 4E, casing 104 has been transitioned to the first position (e.g., via moving of coupling device 112). At this point, receptacle 106 may be coupled to source connector 108. In a particular implementation, casing 104 is completely covered by body 104. As shown in FIG. 4E, only cord 122 is visible as extending from electric power device 400.

Operation of device 400 can be similar to that of device 300; for example, body 102 can define one or more inner sleeves 140, each for receiving a receptacle 106. The primary difference is that, in device 400, lever(s)—rather than a twist barrel or slider—are used to move the receptacle(s) between the first and second positions. The lever(s) can accomplish such movement in any suitable fashion, such as, for example, being coupled to their respective receptacle(s) via linkages, gears, and/or the like.

Thus, FIGS. 4A-4E describe electric power device 400, which acts as an outdoor outlet (a "hideout safe outdoor outlet"). For example, casing 104 and body 102 shelters and seals the connection point between an extension cord (e.g., plug 120) and receptacle 106 to protect the connection point from moisture. To protect the user, power is not activated (e.g., provided to plug 120) until plug 120 is engaged in receptacle 106 and both are pushed back and sealed in casing 104 and body 102. The "live" components are thus inside and are designed to be out of reach to the user during the insertion process.

Figure 5:
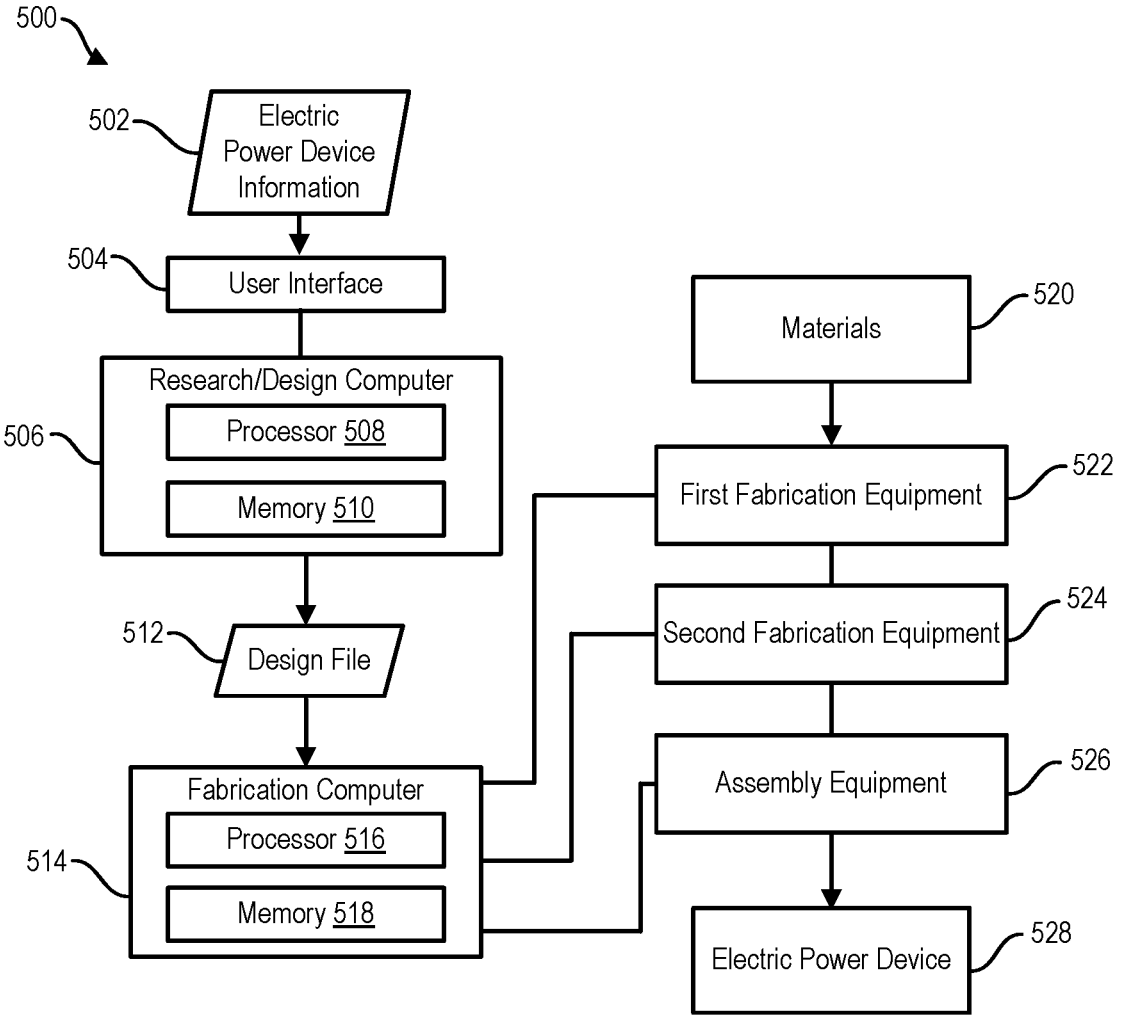
FIG. 5 is a block diagram of an example of a system for fabricating an electric power device with integrated safety measure.

The foregoing disclosed electric power devices may be designed and configured into computer files stored on a computer readable media. Some or all of such files may be provided to fabrication handlers who fabricate the electric power devices based on such files. FIG. 5 depicts an example of a system 500 for fabricating electric power devices.

Electric power device information 502 is received at a research/design computer 506. Electric power device information 502 may include design information representing at least one physical property of an electric power device, such as electric power devices 100, 200, 300, and/or 400. For example, electric power device information 502 may include measurements of casings, measurements of bodies, locations of materials, etc., that are entered via a user interface 504 coupled to research/design computer 506. Research/design computer 506 includes a processor 508, such as one or more processing cores, coupled to a computer readable medium (e.g., a computer readable storage device), such as a memory 510. Memory 510 may store computer readable instructions that are executable to cause processor 508 to transform electric power device information 502 into a design file 512. Design file 512 may include information indicating a design for an electric power device, such as measurements of a casing, measurements of a body, etc. Design file 512 may be in a format that is usable by other systems to perform fabrication, as further described herein.

Design file 512 is provided to a fabrication computer 514 to control fabrication equipment during a fabrication process for material 520. Fabrication computer 514 includes a processor 516 (e.g., one or more processors), such as one or more processing cores, and a memory 518. Memory 518 may include executable instructions such as computer-readable instructions or processor-readable instructions that are executable by a computer, such as processor 516. The executable instructions may enable processor 516 to control fabrication equipment, such as by sending one or more control signals or data, during a fabrication process for materials 520. In some implementations, the fabrication system (e.g., an automated system that performs the fabrication process) may have a distributed architecture. For example, a high-level system (e.g., processor 516) may issue instructions to be executed by controllers of one or more lower-level systems (e.g., individual pieces of fabrication equipment). The lower-level systems may receive the instructions, may issue sub-commands to subordinate modules or process tools, and may communicate status back to the high-level system. Thus, multiple processors (e.g., processor 516 and one or more controllers) may be distributed in the fabrication system.

The fabrication equipment includes first fabrication equipment 522, second fabrication equipment 524, and assembly equipment 526. First fabrication equipment 522 is configured to form a body from materials 520. The body may be formed by drilling, cutting, etching, milling, molding, injecting, etc. Second fabrication equipment 524 is configured to form a casing from materials 520. The casing may be formed by drilling, cutting, etching, milling, molding, injecting, etc.

Assembly equipment 526 is configured to assemble the fabricated pieces into a device. For example, the casing may be coupled to the body, as a non-limiting example.

Performing the fabrication operations on materials 520 operates to form electric power device 528. Electric power device 528 includes a body, a receptacle configured to receive a plug, a source connector configured to be coupled to a power source, and a casing coupled to the body and movable with respect to the body between two positions (e.g., a first position in which the casing defines an enclosed chamber and access to the receptacle is inhibited, and a second position in which the casing is configurable to enable access to the receptacle for receipt of the plug). For example, electric power device 528 may include or correspond to electric power devices 100, 200, 300, or 400.

System 500 enables fabrication of an electric power device with integrated safety measure. For example, the casing of the electric power device may be moved to the second position to enable a plug to be coupled to a receptacle, and after coupling the plug to the receptacle, the casing may be moved to a first position to electrically couple the plug and receptacle to the source connector. Thus, power is not supplied to the plug until the casing is moved and the plug (and receptacle) retract within the body, which may prevent moisture from causing a ground fault and injuring a person (e.g., a user).

Figure 6:
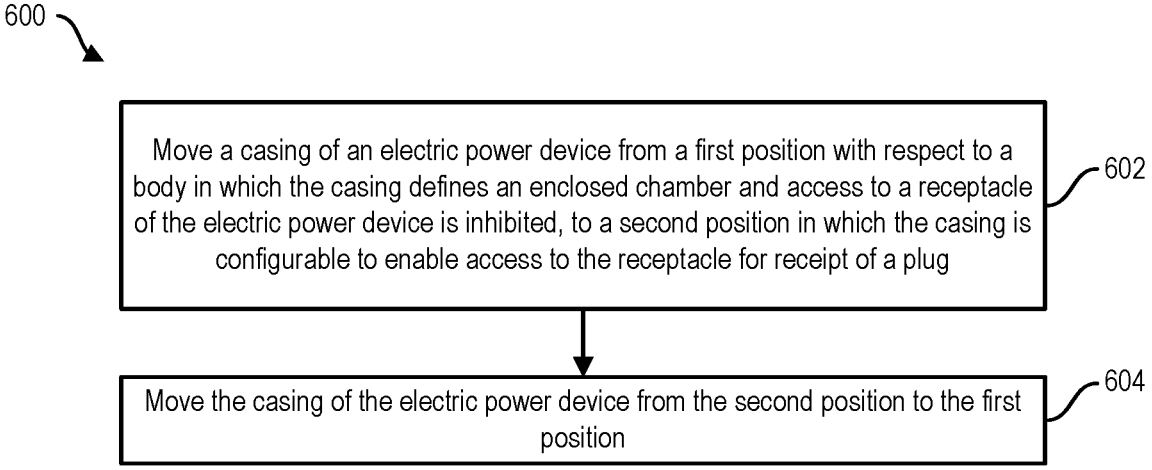
FIG. 6 is a flowchart illustrating an example of a method of operating an electric power device with integrated safety measure.

Referring to FIG. 6, an example of operating an electric power device with integrated safety measure is show. Method 600 may be performed by electric power devices 100, 200, 300, 400, or 528, as non-limiting examples.

Method 600 includes moving a casing of an electric power device from a first position with respect to a body in which the casing defines an enclosed chamber and access to a receptacle of the electric power device is inhibited, to a second position in which the casing is configurable to enable access to the receptacle for receipt of a plug, at 602. For example, the body, the casing, and the receptacle may include or correspond to body 102, casing 104, and receptacle 106, respectively. Moving the casing from the first position to the second position is configured to cause the receptacle to transition from being electrically coupled to a source connector of the electric power device at the first position to being electrically decoupled from the source connector, such that the receptacle is electrically decoupled from the source connector while at the second position. For example, the source connector may include or correspond to source connector 108.

Method 600 includes moving the casing of the electric power device from the second position to the first position, at 604. Moving the casing from the second position to the first position is configured to cause the receptacle to transition from being electrically decoupled to the source connector at the second position to being electrically coupled to the source connector, such that the receptacle is electrically coupled to the source connector while at the first position.

In a particular implementation, method 600 includes, while the casing is at the first position, receiving a first input to initiate movement of the casing from the first position to the second position. Moving the casing from the first position to the second position is responsive to the first input. For example, the input may be received via coupler device 112, such as a twist barrel or a lever, as illustrate, non-limiting examples. In this implementation, method 600 includes, while the casing is at the second position, enabling access to the receptacle and receiving the plug at the receptacle. In this implementation, method 600 also includes, after receiving the plug, receiving a second input to initiate movement of the casing from the second position to the first position. Moving the casing form the second position to the first position is responsive to the second input. In this implementation, method 600 further includes activating one or more indicators based on the receptacle being electrically coupled to the source connector when the source connector is in an energized state. For example, the one or more indicators may include or correspond to the one or more indicators 130.

Thus, method 600 enables a operation of an electric power device with integrated safety measure. For example, the casing of the electric power device may be moved to the second position to enable a plug to be coupled to a receptacle, and after coupling the plug to the receptacle, the casing may be moved to a first position to electrically couple the plug and receptacle to the source connector. Thus, power is not supplied to the plug until the casing is moved and the plug (and receptacle) retract within the body, which may prevent moisture from causing a ground fault and injuring a person (e.g., a user).

The above specification and examples provide a complete description of the structure and use of illustrative implementations. Although certain implementations have been described above with a certain degree of particularity, or with reference to one or more individual implementations, those skilled in the art could make numerous alterations to the disclosed implementations without departing from the scope of this disclosure. As such, the various illustrative implementations of the methods and systems are not intended to be limited to the particular forms disclosed. Rather, they include all modifications and alternatives falling within the scope of the claims, and implementations other than the one shown may include some or all of the features of the depicted implementations. For example, elements may be omitted or combined as a unitary structure, connections may be substituted, or both. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one implementation or may relate to several implementations. Accordingly, no single implementation described herein should be construed as limiting and implementations of the disclosure may be suitably combined without departing from the teachings of the disclosure.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An electric power device for providing power to a plug, the electric power device comprising:

a body;

a receptacle configured to receive a plug;

a source connector configured to be coupled to a power source;

a casing coupled to the body and movable with respect to the body between:

a first position in which the casing defines an enclosed chamber and access to the receptacle is inhibited; and a second position in which the casing is configurable to enable access to the receptacle for receipt of the plug;

wherein a transition from the first position to the second position is configured to cause the receptacle to be electrically decoupled from the source connector when the casing is at the second position; and wherein a transition from the second position to the first position is configured to cause the receptacle to be electrically coupled to the source connector when the casing is at the first position.

2. The electric power device of claim 1, further comprising a power supply cord including one or more conductors coupled to the source connector.

3. The electric power device of claim 1, wherein:

movement of the casing from the second position to the first position is configured to cause the casing to engage one or more flex spring arms coupled to the source connector such that, when the casing is at the second position, the one or more flex spring arms cause the receptacle to be electrically coupled to the source connector; and each of the one or more flex spring arms biased toward a position in which the receptacle is electrically decoupled from the source connector.

4. The electric power device of claim 1, wherein:

the casing comprising a flexible plastic seal having a first portion and a second portion;

in the first position, the first portion and the second portion are separable at an end of the casing to enable access to the receptacle; and in the second position, the first portion and the second portion are prevented by the body from being separated at the end of the casing to prohibit access to the receptacle.

5. The electric power device of claim 1, wherein the body comprises an outlet box.

6. The electric power device of claim 1, further comprising one or more indicators configured to provide a first indication of an electrical state of the source connector, a second indication of an electrical state of the receptacle, or both.

7. The electric power device of claim 1, wherein at least a portion of the body, the casing, or both are transparent to enable the plug coupled to the receptacle to be visible while the plug is coupled to the receptacle when the receptacle is at the first position.

8. The electric power device of claim 1, wherein the casing includes a first portion and a second portion, at least one of the first portion and the second portion includes a channel.

9. The electric power device of claim 8, wherein the first portion is coupled to the second portion and is configured to rotate about the second portion while at the second position to enable access to the receptacle.

10. The electric power device of claim 1, further comprising a coupling device configured to enable:

movement of the casing in a first direction with respect to the body, the first direction corresponding to the transition from the first position to the second position; and movement of casing in a second direction with respect to body, the second direction opposite the first direction and corresponding to the transition from the second position to the first position.

11. The electric power device of claim 10, wherein the coupling device comprises a twist barrel.

12. The electric power device of claim 11, wherein rotation of the twist barrel causes movement of the casing such that rotation in a first direction causes movement in a first direction and rotation in a second direction causes movement in a second direction opposite the first direction.

13. The electric power device of claim 10, wherein the coupling device comprises a lever.

14. The electric power device of claim 13, wherein:

a first operation of the lever causes movement of the casing in a first direction with respect to the body; and a second operation of the lever causes movement of the casing in a second direction with respect to the body, the second direction opposite the first direction.

15. The electric power device of claim 1, wherein the receptacle comprises one or more conductive members configured to physically couple to one or more conductive members of the plug.

16. The electric power device of claim 15, wherein:

movement of the casing from the second position to the first position is configured to cause the casing to engage one or more flex spring arms coupled to the source connector such that, when the casing is at the second position, the one or more flex spring arms cause the receptacle to be electrically coupled to the source connector; and each of the one or more flex spring arms is biased toward a position in which the receptacle is electrically decoupled from the source connector.

17. The electric power device of claim 16, wherein the coupling device comprises a twist barrel.

18. A method of operating an electric power device, the method comprising:

moving a casing of an electronic power device from a first position with respect to a body in which the casing defines an enclosed chamber and access to a receptacle of the electric power device is inhibited, to a second position in which the casing is configurable to enable access to the receptacle for receipt of a plug;

wherein moving the casing from the first position to the second position is configured to cause the receptacle to transition from being electrically coupled to a source connector of the electric power device at the first position to being electrically decoupled from the source connector, such that the receptacle is electrically decoupled from the source connector while at the second position.

19. The method of claim 18, further comprising:

moving the casing of the electric power device from the second position to the first position; and wherein moving the casing from the second position to the first position is configured to cause the receptacle to transition from being electrically decoupled to the source connector at the second position to being electrically coupled to the source connector, such that the receptacle is electrically coupled to the source connector while at the first position.

20. The method of claim 18, further comprising:

while the casing is at the first position, receiving a first input to initiate movement of the casing from the first position to the second position, wherein moving the casing from the first position to the second position is responsive to the first input;

while the casing is at the second position: enabling access to the receptacle, and receiving the plug at the receptacle;

after receiving the plug, receiving a second input to initiate movement of the casing from the second position to the first position, wherein moving the casing form the second position to the first position is responsive to the second input; and activating one or more indicators based on the receptacle being electrically coupled to the source connector when the source connector is in an energized state.

* * * * *